US009568877B2

(12) United States Patent
Kamihara et al.

(10) Patent No.: US 9,568,877 B2
(45) Date of Patent: Feb. 14, 2017

(54) IMAGE FORMING APPARATUS THAT PERFORMS COMPULSORY TONER CONSUMPTION PROCESSING

(71) Applicants: Kazuaki Kamihara, Tokyo (JP); Takuma Higa, Kanagawa (JP); Toshiaki Motohashi, Chiba (JP)

(72) Inventors: Kazuaki Kamihara, Tokyo (JP); Takuma Higa, Kanagawa (JP); Toshiaki Motohashi, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/044,070

(22) Filed: Feb. 15, 2016

(65) Prior Publication Data

US 2016/0252864 A1 Sep. 1, 2016

(30) Foreign Application Priority Data

Feb. 27, 2015 (JP) ..... 2015-038551

(51) Int. Cl.
*G03G 15/00* (2006.01)
*G03G 21/00* (2006.01)
*G03G 15/01* (2006.01)

(52) U.S. Cl.
CPC ..... *G03G 15/556* (2013.01); *G03G 15/0189* (2013.01); *G03G 15/553* (2013.01); *G03G 21/0041* (2013.01)

(58) Field of Classification Search
CPC G03G 15/556; G03G 15/553; G03G 15/0189; G03G 15/161; G03G 21/0041; G03G 2215/1647; G03G 2215/1661
(Continued)

(56) References Cited

U.S. PATENT DOCUMENTS 6,192,205 B1 2/2001 Motohashi
2002/0034408 A1 3/2002 Motohashi
(Continued)

FOREIGN PATENT DOCUMENTS

JP 2009-150931 7/2009
JP 2013235062 A 11/2013

OTHER PUBLICATIONS

European Search Report, EP16156497, Aug. 3, 2016.

*Primary Examiner* — Sophia S Chen
(74) *Attorney, Agent, or Firm* — Duft Bornsen & Fettig LLP

(57) ABSTRACT

An image forming apparatus is provided. The image forming apparatus includes an image forming device to form images of color toners on corresponding image bearers of at least four image bearers; a transferring device to transfer the color toner images on the image bearers to a transfer medium; and a controller to control the image forming apparatus. The controller performs a compulsory toner consumption processing for the color toners to compulsory consume deteriorated toners. When the compulsory toner consumption processing is performed on three or more toners, compulsory consumption toner images of the color toners are formed on the corresponding image bearers and then transferred to the transfer medium to form a compulsory consumption combined toner image including at least two overlaid image portions, wherein the at least two overlaid image portions are arranged side by side with a space therebetween in a width direction of the transfer medium.

8 Claims, 12 Drawing Sheets

(58) Field of Classification Search
USPC ..... 399/72, 27, 49, 71, 101
See application file for complete search history.

(56) References Cited

U.S. PATENT DOCUMENTS

| | | | | |
|---|---|---|---|---|
| 2007/0059007 | A1* | 3/2007 | Ai | G03G 15/161 399/49 |
| 2009/0245828 | A1* | 10/2009 | Ito | G03G 15/5058 399/49 |
| 2014/0169813 | A1 | 6/2014 | Seki et al. | |
| 2014/0321874 | A1* | 10/2014 | Sugiura | G03G 15/161 399/71 |
| 2015/0160599 | A1 | 6/2015 | Kamihara et al. | |
| 2016/0077467 | A1* | 3/2016 | Takahashi | G03G 15/163 399/101 |

* cited by examiner

MAIN SCANNING DIRECTION LAYOUT FLAG = 0

MAIN SCANNING DIRECTION LAYOUT FLAG = 1

IMAGE FORMING APPARATUS THAT PERFORMS COMPULSORY TONER CONSUMPTION PROCESSING

CROSS-REFERENCE TO RELATED APPLICATIONS

This patent application is based on and claims priority pursuant to 35 U.S.C. §119 to Japanese Patent Application No. 2015-038551 filed on Feb. 27, 2015 in the Japan Patent Office, the entire disclosure of which is hereby incorporated by reference herein.

BACKGROUND

Technical Field

This disclosure relates to an image forming apparatus.

Description of the Related Art

Image forming apparatuses are well known which include an image forming device having plural image bearers and which perform a compulsory toner consumption processing such that a toner image (hereinafter referred to as a compulsory consumption toner image) is forcibly formed on at least one of the plural image bearers to consume the toner, thereby making it possible to discharge deteriorated toner from the image forming device.

For example, there is a proposal for an image forming apparatus which includes, as the plural image bearers, four photoconductors on which yellow (Y), magenta (M), cyan (C) and black (K) toner images are formed respectively. In the image forming apparatus, a narrow Y toner image extending in the main scanning direction (i.e., optical scanning direction when an electrostatic latent image is formed on the photoconductor) is forcibly formed on the Y photoconductor while a narrow C toner image extending in the main scanning direction is forcibly formed on the C photoconductor, and the Y and C toner images are transferred to a transfer belt serving as a transfer medium so as to be overlaid (i.e., to form a combined Y and C toner image). In addition, a narrow M toner image extending in the main scanning direction is forcibly formed on the M photoconductor while a K toner image extending in the main scanning direction is forcibly formed on the K photoconductor, and the M and K toner images are transferred to the transfer belt so as to be overlaid (i.e., to form a combined M and K toner image). In this regard, the Y and C combined toner image and the M and K combined toner image are arranged side by side in the sub-scanning direction (i.e., moving direction of the transfer belt) with a predetermined space therebetween.

It is described in the proposal that since two combined color toner images are formed side by side, the travel distance of the transfer belt in the compulsory toner consumption processing can be reduced so as to be shorter than in a case in which Y, M, C and K toner images are formed side by side without being overlaid.

SUMMARY

As an aspect of this disclosure, an image forming apparatus is provided which includes an image forming device which includes at least four image bearers and which forms images of color toners on corresponding image bearers of the at least four image bearers; a transferring device which includes a movable transfer medium and which transfers the color toner images on the at least four image bearers to the transfer medium; and a controller to control the image forming apparatus. The controller performs a compulsory toner consumption processing including calculating a necessary toner compulsory consumption amount of each of the color toners to determine a necessary toner compulsory consumption cumulative amount thereof; specifying color toners whose necessary toner compulsory consumption cumulative amount is greater than a threshold value; forming compulsory consumption toner images of the specified color toners on the corresponding image bearers; and transferring the compulsory consumption toner images to the transfer medium to form a compulsory consumption combined toner image on the transfer medium. When the number of the specified color toners is three or more, the compulsory consumption combined toner image includes at least two overlaid image portions each consisting of two of the compulsory consumption toner images, wherein the at least two overlaid image portions are arranged side by side with a space therebetween in a first direction perpendicular to the moving direction of the transfer medium.

The aforementioned and other aspects, features and advantages will become apparent upon consideration of the following description of the preferred embodiments taken in conjunction with the accompanying drawings.

DETAILED DESCRIPTION

The conventional image forming apparatus mentioned above has a drawback in that efficiency of the compulsory toner consumption processing (hereinafter referred to as compulsory toner consumption efficiency) is deteriorated because a space is formed between the combined Y and C toner image and the combined M and K toner image in the sub-scanning direction.

Hereinafter, an electrophotographic color printer (hereinafter referred to as a printer) which is an example of the image forming apparatus of this disclosure will be described.

Figure 1:
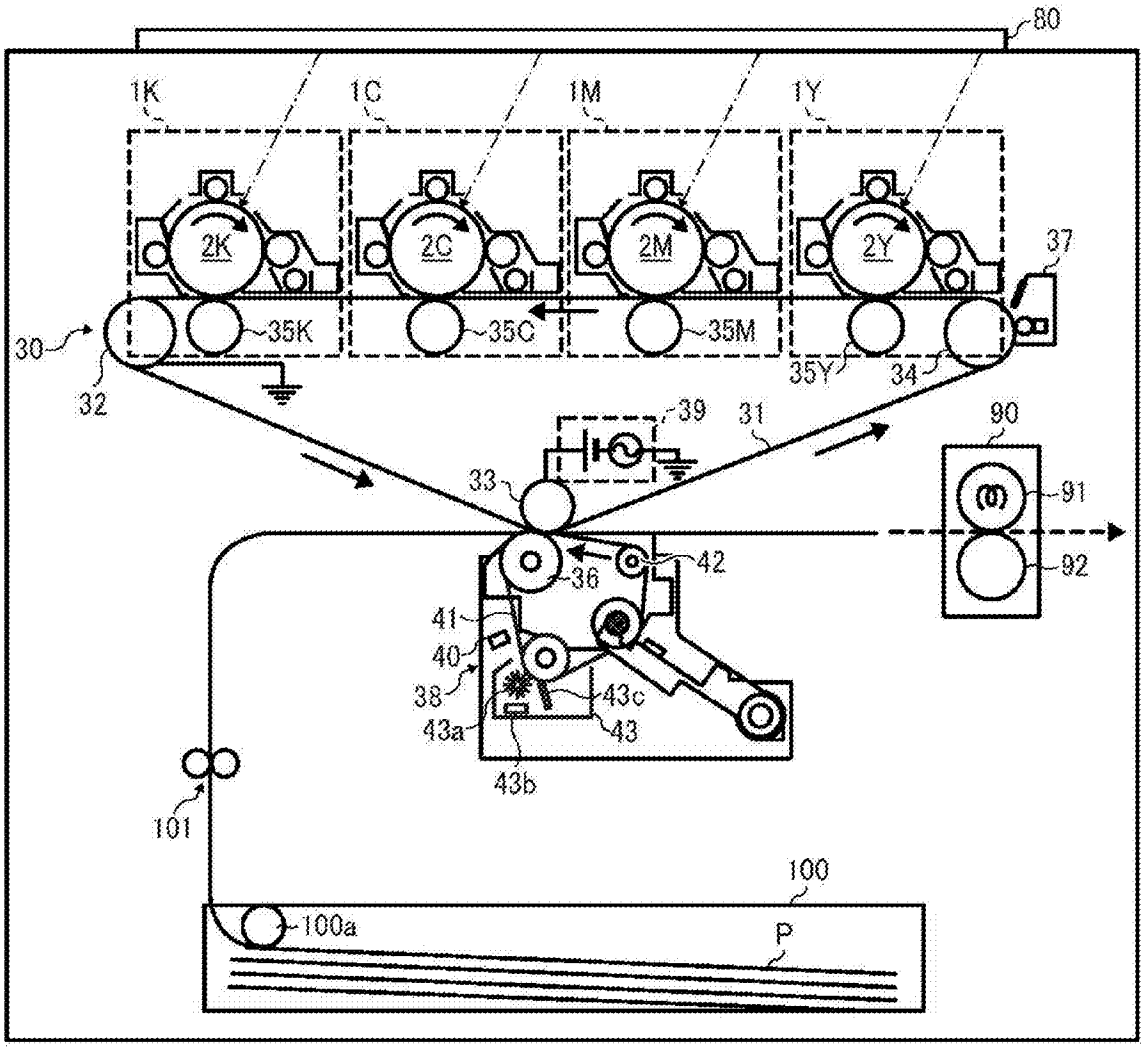
FIG. 1 is a schematic view illustrating a printer as an image forming apparatus according to an embodiment of this disclosure.

Initially, the basic configuration of the printer will be described. FIG. 1 is a schematic view illustrating the printer. Referring to FIG. 1, the printer includes four image forming units 1Y, 1M, 1C and 1K which form yellow (Y), magenta (M), cyan (C) and black (K) toner images, respectively, a transferring unit 30, an optical writing unit 80, a fixing device 90, a sheet feeding cassette 100, a pair of registration rollers 101, etc.

Figure 2:
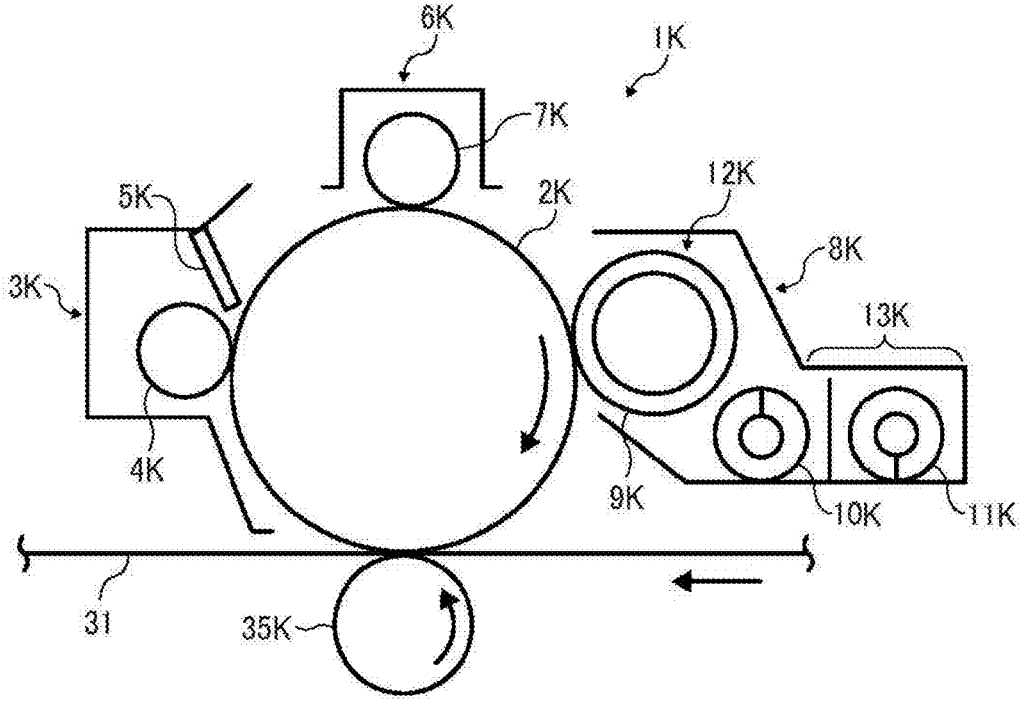
FIG. 2 is an enlarged view illustrating a black (K) image forming unit of the printer.

The four image forming units 1Y, 1M, 1C and 1K have the same configuration except that different color toners, i.e., Y, M, C and K toners, are used as the image forming material, and are replaced with new image forming units when the life thereof expires. Since the four image forming units 1 have the same configuration, the black (K) image forming unit 1K, which is illustrated in FIG. 2, will be described as an example of the image forming units. Referring to FIG. 2, the K image forming unit 1K includes a drum-shaped photoconductor 2K, a drum cleaner 3K, a discharger, a charger 6K, a developing device 8K, etc. Since these devices are supported by a common supporter so as to be detachably attachable to the main body of the printer as a unit, the devices can be replaced with new devices at the same time.

The photoconductor 2K has a configuration such that an organic photosensitive layer is formed on a surface of a drum-shaped substrate, and is rotated clockwise by a driving device. The charger 6K includes a charging roller 7K to which a charging bias is applied and which is arranged so as to be contacted with or closer to the photoconductor 2K to evenly charge the surface of the photoconductor 2K by causing discharge between the photoconductor and the charging roller. In this printer, the surface of the photoconductor 2K is evenly charged so as to have a charge with the same polarity as that of the normal charge of the toner used for developing, and a DC voltage on which an AC voltage is superimposed (hereinafter referred to as an AC and DC superimposition voltage) is used as the charging bias. The charging roller 7K has a configuration such that an electroconductive elastic layer is formed on a surface of a metal shaft. The charging method is not limited to such contact or short-range charging using a charging roller, and a method using a corona charger can also be used.

The evenly charged surface of the photoconductor 2K is scanned with a laser beam emitted by the optical writing unit 80 (described later in detail), resulting in formation of an electrostatic latent image of the K image on the surface of the photoconductor. The electrostatic latent image is developed by the developing device using a K toner, resulting in formation of a K toner image on the surface of the photoconductor 2K. The K toner image is primarily transferred to an intermediate transfer belt 31 serving as a transfer medium.

The drum cleaner 3K removes toner remaining on the surface of the photoconductor 2K even after the primary transfer process. The drum cleaner 3K includes a cleaning brush roller 4K which is driven to rotate, and a cleaning blade 5K one end of which is supported by a housing of the cleaner and the other end of which is a free end contacted with the surface of the photoconductor 2K. The rotated cleaning brush 4K scrapes residual toner from the surface of the photoconductor 2K, and the cleaning blade 5K scrapes residual toner off the surface of the photoconductor.

The discharger mentioned above removes charges remaining on the surface of the photoconductor 2K even after the cleaning process. By performing this discharging process, the surface of the photoconductor 2K is initialized so as to be ready for the next image forming process.

The developing device 8K includes a developing part 12K including a developing roller 9K, and a developer feeding part 13K to feed a K developer including the K toner while stirring the developer. The developer feeding part 13K includes a first feeding chamber including a first screw member 10K therein, and a second feeding chamber including a second screw member 11K therein. Each of the first and second screw members 10K and 11K has a rotary shaft, both ends of which are rotatably supported by bearings, and a spiral blade projecting from the rotary shaft.

The first feeding chamber is separated from the second feeding chamber with a partition, but both ends of the partition relative to the axis direction of the screw members 10K and 11K have communicating openings so that the first and second feeding chambers are communicated with each other. The first screw member 10K rotates while bearing the K developer in the spiral blade to feed the K developer in a direction of from the inner side (in FIG. 2) of the first feeding chamber to the front side thereof while stirring the developer. In this regard, since the first screw member 10K is opposed to the developing roller 9K so as to be parallel to the developing roller, the K developer is fed in the axis direction of the developing roller 9K. Therefore, the first screw member 10K supplies the K developer to the developing roller 9K in the axis direction of the developing roller.

The K developer fed by the first screw member 10K to the front end of the first feeding chamber is fed to the second feeding chamber through the communicating opening on the front side so as to be born in the spiral blade of the second screw member 11K. The K developer is fed to the inner side (in FIG. 2) of the second feeding chamber by the second screw member 11K while stirred by the rotated second screw member.

A toner concentration sensor is arranged on a bottom wall of the casing of the second feeding chamber to detect the concentration of the K toner in the K developer in the second feeding chamber. A magnetic permeability sensor is used as the toner concentration sensor. Since the K developer includes the K toner and a magnetic carrier, the magnetic permeability of the K developer correlates with the K toner concentration, and therefore the magnetic permeability sensor serving as the toner concentration sensor can detect the K toner concentration.

The Y, M, C and K developing devices 8 respectively include Y, M, C and K supplying devices which are arranged in the second feeding chambers of developing devices to supply the Y, M, C and K developers thereto. A main controller (described later) of the printer includes a random access memory (RAM) in which target values of the output voltages Vtref output from the Y, M, C and K toner concentration sensors are stored. When the differences between the voltages output from the Y, M, C and K toner concentration sensors and the target values Vtref thereof exceed a predetermined value, the main controller drives the Y, M, C and K toner supplying devices for a period of time corresponding to the differences, thereby supplying the Y, M, C and K toners to the second feeding chambers of the corresponding developing devices. Hereinafter, the voltage output from the toner concentration sensor is sometimes referred to as a toner concentration detection result, and the target value of the output voltage Vtref is sometimes referred to as a toner concentration target value.

The developing roller 9K in the developing part 12K is opposed to the first screw member 10K while facing the photoconductor 2K through an opening of the casing of the developing device 8K. The developing roller 9K includes a cylindrical developing sleeve which is a non-magnetic pipe and which is driven to rotate, and a magnet roller fixedly arranged in the developing sleeve. The developing roller 9K bears the K developer, which is supplied by the first screw member 10K, on the surface of the developing sleeve with a magnetic force of the magnet roller, and feeds the developer to a development region, at which the developing roller is opposed to the photoconductor 2K, as the developing roller rotates.

A developing bias, which has the same polarity as that of charge of the toner and which is greater in absolute value than the potential of the electrostatic latent image formed on the photoconductor 2K and is smaller in absolute value than the potential of the evenly charged photoconductor, is applied to the developing sleeve, thereby forming a development potential between the developing sleeve and the electrostatic latent image on the photoconductor 2K, wherein the K toner on the developing sleeve is electrostatically moved toward the electrostatic latent image by the development potential. In addition, a non-development potential, by which the K toner on the developing sleeve is moved toward the surface of the developing sleeve, is formed between the developing sleeve and the background area (i.e., non-image area) of the photoconductor 2K. Due to the development potential and the non-development potential, the K toner on the developing sleeve is selectively transferred to the electrostatic latent image on the photoconductor 2K, resulting in formation of a K toner image on the photoconductor.

Referring back to FIG. 1, similarly to the K image forming unit 1K mentioned above, Y, M and C toner images are also formed on the Y, M and C photoconductors 2Y, 2M and 2C of the Y, M and C image forming units 1Y, 1M and 1C. The optical writing unit 80 serving as a latent image forming device is provided above the image forming units 1Y, 1M, 1C and 1K. The optical writing unit 80 optically scans the surfaces of the photoconductors 2Y, 2M, 2C and 2K with laser beams emitted by a light source including laser diodes based on image information sent from an external device such as personal computers, thereby forming an electrostatic latent image on each of the photoconductors. In the optical writing unit 80, laser beams emitted by the light source are deflected by a polygon mirror, which is driven by a polygon motor to rotate, so as to irradiate the surface of the photoconductors 2Y, 2M, 2C and 2K via plural optical lenses and mirrors. In this regard, an optical writing device using a light emitting diode (LED) array including plural LEDs can also be used as the optical writing unit 80. In this regard, the main scanning direction is defined as a direction along which the laser beams are scanned and which is perpendicular to the rotation direction of the photoconductor and the moving direction of the intermediate transfer belt 31. In this application, the main scanning direction is sometimes referred to as a first direction.

The transferring unit serving as a transferring device, which is arranged below the image forming units 1Y, 1M, 1C and 1K, includes the endless intermediate transfer belt 31, which is driven to rotate counterclockwise while tightly stretched. The transferring unit 30 further includes a driving roller 32, a secondary transfer bias roller 33, a cleaner backup roller 34, four primary transfer rollers 35Y, 35M, 35C and 35K, and a first belt cleaner 37.

The intermediate transfer belt 31 is tightly stretched by the driving roller 32, the secondary transfer bias roller 33, the cleaner backup roller 34, and the four primary transfer rollers 35Y, 35M, 35C and 35K, which are arranged inside the intermediate transfer belt. The intermediate transfer belt 31 is rotated counterclockwise by the driving roller 32, which is driven by a driving device to rotate counterclockwise.

The four primary transfer rollers 35Y, 35M, 35C and 35K sandwich the intermediate transfer belt 31 with the photoconductors 2Y, 2M, 2C and 2K, thereby forming primary transfer nips at which the surface of the intermediate transfer belt is contacted with the surfaces of the photoconductors. A primary transfer bias is applied to each of the primary transfer rollers 35Y, 35M, 35C and 35K by a primary transfer power source, thereby forming a primary transfer electric field between the primary transfer rollers and the Y, M, C and K toner images on the photoconductors 2Y, 2M, 2C and 2K.

The Y toner image formed on the photoconductor 2Y is fed to the Y primary transfer nip as the photoconductor rotates, and is primarily transferred to the intermediate transfer belt 31 by the primary transfer nip pressure and the primary transfer electric field. The intermediate transfer belt 31 bearing the Y toner image thereon passes the M, C and K primary transfer nips sequentially, and the M, C and K toner images on the photoconductors 2M, 2C and 2K are transferred sequentially to the intermediate transfer belt so as to be overlaid on the Y toner image, thereby forming a combined color toner image of the four color toner images on the intermediate transfer belt. In this regard, a transfer charger or a transfer brush can be used instead of each of the primary transfer rollers 35Y, 35M, 35C and 35K.

A nip forming unit 38 including a secondary transfer ground roller 36, an optical sensor unit 40, an endless nip forming belt 41, and a second belt cleaner 43 is arranged below the transferring unit 30. The nip forming belt 41 is rotated clockwise by any one of the plural rollers (such as the secondary transfer ground roller 36) arranged inside the nip forming belt while tightly stretched by the plural rollers. The nip forming belt 41 forms a secondary transfer nip with the intermediate transfer belt 31 at a location in which the secondary transfer bias roller 33 faces the secondary transfer ground roller 36. Namely, the secondary transfer bias roller 33 and the secondary transfer ground roller 36 sandwich the intermediate transfer belt 31 and the nip forming belt 41 at the secondary transfer nip, so that the front surface of the intermediate transfer belt is contacted with the front surface of the nip forming belt 41. In this regard, the secondary transfer ground roller 36 arranged inside the nip forming belt 41 is grounded, and a secondary transfer bias is applied to the secondary transfer bias roller 33, which is arranged inside the intermediate transfer belt 31, by a power source for secondary transfer (hereinafter secondary transfer power source) 39, thereby forming a secondary transfer electric field between the secondary transfer bias roller 33 and the secondary transfer ground roller 36 to electrostatically move the toner having a negative polarity toward the secondary transfer ground roller 36 from the secondary transfer bias roller 33. A secondary transfer roller can be used as the nip forming member instead of the nip forming belt 41. In this case, the secondary transfer roller can be directly contacted with the intermediate transfer belt 31.

After the intermediate transfer belt 31 passes the secondary transfer nip, the first belt cleaner 37 which is contacted with the front surface of the intermediate transfer belt removes toner remaining on the surface of the intermediate transfer belt without being transferred to a recording sheet P. The cleaner backup roller 34, which is arranged inside the intermediate transfer belt 31, backs up the cleaning operation of the first belt cleaner 37 from the inside of the intermediate transfer belt.

The toner image thus formed on the intermediate transfer belt 31 based on the image information sent from the external device such as personal computers and scanners is secondarily transferred to the recording sheet P at the secondary transfer nip. In contrast, predetermined test toner images formed on the intermediate transfer belt 31 to check the image forming ability of the image forming units 1Y, 1M, 1C and 1K are secondarily transferred to the nip forming belt 41 at the secondary transfer nip.

The optical sensor unit 40 of the nip forming unit 38 includes plural reflection type photosensors, and is arranged so as to face the front surface of the nip forming belt 41 with a predetermined gap therebetween. When the test toner images on the nip forming belt 41 enter into the gap, the plural reflection type photosensors detect the amount (per unit area) of toner of each of the test toner images, i.e., the photosensors measure the image density of each of the test toner images.

The reason why the amount of toner is measured with respect to each of the test toner images on the nip forming belt 41 instead of the test toner images on the intermediate transfer belt 31 is the following. Specifically, the best method of removing foreign materials (such as residual toner) from an endless belt is a method in which such foreign materials are scraped off the surface of the belt by a cleaning blade whose edge is contacted with the surface of the belt. However, the intermediate transfer belt 31 has an elastic outermost layer, and if a cleaning blade is contacted with the elastic outermost layer, the cleaning blade often causes a stick-slip phenomenon. Therefore, it is difficult to use a blade cleaning method for the intermediate transfer belt 31, and a cleaning method using a brush roller is used as the first belt cleaner 37 for cleaning the intermediate transfer belt. In this regard, the first belt cleaner 37 using a brush roller can remove a relatively small amount of residual toner, but tends to cause a toner re-adhesion problem if a relatively large amount of residual toner is present on the intermediate transfer belt 31, wherein the toner re-adhesion problem is that the residual toner caught by the brush of the brush roller is ejected from the brush, thereby soiling the recording sheet P and the devices in the vicinity of the brush roller. Therefore, when a toner image whose toner amount is relatively large (such as the test toner images) is formed on the intermediate transfer belt 31 and the toner image is not secondarily transferred to the recording sheet P, the toner image is secondarily transferred to the nip forming belt 41, and the second belt cleaner 43 removes the toner image from the nip forming belt.

A single-layer endless belt including a polyimide as a main component is used as the nip forming belt 41. The nip forming belt 41 using such a belt does not cause the stick-slip phenomenon even when a blade cleaning method is used therefor.

The second belt cleaner 43 includes a cleaning brush roller 43*a*, a solid lubricant 43*b* which is a block of zinc stearate, and a cleaning blade 43*c*. The cleaning brush roller 43*a* is rotated while contacted with the solid lubricant 43*b* and the nip forming belt 41 to apply zinc stearate, which is obtained by the cleaning brush roller by scraping the solid lubricant, to the surface of the nip forming belt, thereby enhancing the toner releasability of the surface of the nip forming belt. In addition, the cleaning brush roller 43*a* removes foreign materials (such as residual toner) from the surface of the nip forming belt 41. The cleaning blade 43*c* is contacted with the surface of the nip forming belt 41 after the surface is contacted with the cleaning brush roller 43*a* to scrape foreign materials off the surface of the nip forming belt. Therefore, even when toner caught by the cleaning brush roller 43*a* is adhered again to the nip forming belt 41 on an upstream side from the cleaning blade 43*c* relative to the moving direction of the nip forming belt, the cleaning blade can remove the toner from the surface of the nip forming belt.

The sheet feeding cassette 100 is arranged below the nip forming unit 38 to contain a bundle of recording sheets P. The sheet feeding cassette 100 includes a sheet feeding roller 100*a*, which is contacted with the uppermost recording sheet P of the bundle of recording sheets in the sheet feeding cassette to timely feed the recording sheet toward a feeding passage. The pair of registration rollers 101 is arranged at the end of the feeding passage. When the recording sheet fed from the sheet feeding cassette 100 reaches the nip between the two rollers of the registration rollers, the pair of registration rollers stops rotation. The pair of registration rollers 101 timely starts rotation to timely feed the recording sheet P to the secondary transfer nip so that the combined color toner image of the four color toner images is transferred to a proper position of the recording sheet P at the secondary transfer nip. Since the combined color toner image on the intermediate transfer belt 31 is contacted with the recording sheet P at the secondary transfer nip to which a nip pressure and a secondary transfer electric field are applied, the combined color toner image is secondarily transferred to the recording sheet P, resulting in formation of a full color toner image on the recording sheet. The recording sheet P bearing the full color toner image thereon is then separated from the intermediate transfer belt 31 due to curvature of the intermediate transfer belt. In addition, the recording sheet P bearing the full color toner image thereon is separated from the nip forming belt 41 due to curvature of a separating roller 42 supporting the nip forming belt 41 from inside.

In this printer, the secondary transfer nip is formed by contacting the nip forming belt 41 with the intermediate transfer belt 31. However, the secondary transfer nip can be formed by contacting a nip forming roller with the intermediate transfer belt 31.

The fixing device 90 is arranged on a downstream side from the secondary transfer nip relative to the sheet feeding direction. The fixing device 90 includes a fixing roller 91 including a heat source such as a halogen lamp therein, and a pressure roller 92 which is rotated while contacting the fixing roller at a predetermined pressure to form a fixing nip. The recoding sheet P bearing the unfixed full color toner image thereon and fed to the fixing device 90 is nipped by the fixing roller 91 and the pressure roller 92, wherein the unfixed full color toner image is contacted with the fixing roller. Since the unfixed full color toner image is heated upon application of pressure in the fixing device 90, the toners of the full color toner image are softened and thereby the full color toner image is fixed to the recording sheet P. The recording sheet P passing through the fixing device 90 is ejected from the printer after passing through a sheet passage.

In this printer, when a monochromatic image is produced, the position of a supporting plate supporting the primary transfer rollers 35Y, 35M and 35C is changed, for example, by driving a solenoid so that the primary transfer roller 35Y, 35M and 35C are separated from the photoconductors 2Y, 2M and 2C, thereby separating the surface of the intermediate transfer belt 31 from the photoconductors 2Y, 2M and 2C. Thus, only the photoconductor 2K is contacted with the surface of the intermediate transfer belt 31. By operating only the K image forming unit 1K, a K toner image is formed on the photoconductor 2K.

Figure 3:
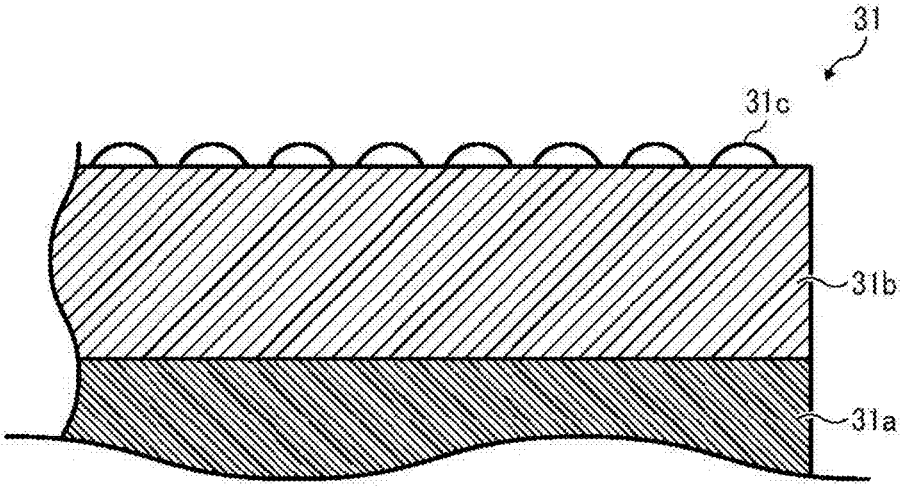
FIG. 3 is an enlarged sectional view illustrating an intermediate transfer belt of the printer.
Figure 4:
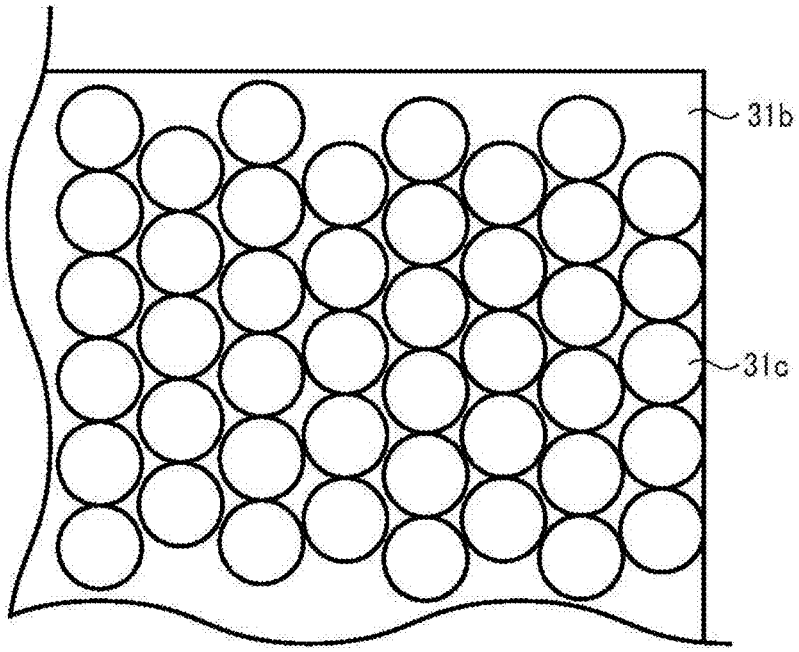
FIG. 4 is an enlarged partial plan view illustrating the intermediate transfer belt.

FIG. 3 is an enlarged cross-sectional view illustrating the intermediate transfer belt 31. The intermediate transfer belt 31 includes an endless base layer 31*a* which is made of a material having a certain level of flexibility and a high stiffness, and an elastic layer 31*b* which is formed on the front surface of the base layer and which is made of an elastic material having a high flexibility. A particulate material 31*c* is dispersed in the elastic layer 31*b*, and part of the particulate material projects from the surface of the elastic layer so as to be arranged on the surface while being tightly packed along the surface of the intermediate transfer belt as illustrated in FIG. 4, thereby forming plural convexes and concaves the surface of the intermediate transfer belt 31.

The base layer 31*a* is, for example, made of a material including a resin and an electric resistance controlling material such as fillers and additives, which is dispersed in the resin to control the electric resistance of the resin. Since the resin preferably has good resistance to flame, for example, fluorine-containing resins such as polyvinylidene fluoride (PVDF) and ethylene-ethylene tetrafluoride copolymer (ETFE), polyimide resins, and polyamideimide resins are preferably used for the resin. In addition, the resin preferably has a good combination of mechanical strength (high elasticity) and heat resistance, and therefore polyimide resins and polyamideimide resins are particularly preferable.

Suitable materials for use as the electric resistance controlling agent to be dispersed in the resin include metal oxides, carbon black, ionic electroconductive agents, and electroconductive polymers. Specific examples of the metal oxides include zinc oxide, tin oxide, titanium oxide, zirconium oxide, aluminum oxide, and silica. Metal oxides subjected to a surface treatment to enhance the dispersibility thereof can also be used. Specific examples of the carbon black include KETJEN BLACK, furnace black, acetylene black, thermal black, and gas black. Specific examples of the ionic electroconductive agents include tetraalkylammonium salts, trialkylbenzylammonium salts, alkylsulfonic acid salts, alkylbenzensulfonic acid salts, alkyl sulfate, fatty acid esters of glycerin, fatty acid esters of sorbitan, polyoxyethylenealkylamine, alcohol esters of polyoxyethylene fatty acids, alkylbetaine, and lithium perchlorate. These electric resistance controlling agents can be used alone or in combination. The electric resistance controlling agent is not limited the above-mentioned materials.

The coating liquid used for forming the base layer 31*a* typically includes a crosslinkable liquid resin (which is a precursor of the base layer) and an electric resistance controlling agent, and optionally includes additives such as dispersing agents, reinforcing agents, lubricants, heat conductive agents, and antioxidants, which are dispersed in the liquid resin. The electric resistance controlling agent is preferably included in the coating liquid in an amount such that the resultant base layer 31*a* has a surface resistivity of from $1\times10^{8}$ to $1\times10^{13}\Omega/\square$ and a volume resistivity of from $1\times10^{6}$ to $1\times10^{12}$ $\Omega\cdot$cm, and in addition the base layer is not brittle and has good mechanical strength. Namely, it is preferable to prepare a seamless belt having a good combination of electric properties (surface resistivity and volume resistivity) and mechanical strength by using a coating liquid including a resin component (such as a precursor of polyimide resin or polyamideimide resin) and an electric resistance controlling agent in a proper ratio. When carbon black is used as the electric resistance controlling agent, the added amount is preferably from 10 to 25% by weight, and more preferably from 15 to 20% by weight, based on the total weight of the solid components included in the coating liquid. When a metal oxide is used as the electric resistance controlling agent, the added amount is preferably from 1 to 50% by weight, and more preferably from 10 to 30% by weight, based on the total weight of the solid components included in the coating liquid. When the added amount of the electric resistance controlling agent is less than the preferable range mentioned above, good effect cannot be produced. In contrast, when the added amount is greater than the preferably range, the mechanical strength of the base layer 31*a* and the intermediate transfer belt 31 tends to deteriorate. Therefore, it is preferable to control the added amount in the preferable range mentioned above.

The thickness of the base layer 31*a* is not particularly limited, but is preferably from 30 μm to 150 μm, more preferably from 40 μm to 120 μm, and even more preferably from 50 μm to 80 μm. When the thickness of the base layer 31*a* is less than 30 μm, the intermediate transfer belt 31 tends to easily tear due to generation of cracks. In contrast, when the thickness is greater than 150 μm, the intermediate transfer belt 31 is easily cracked when bent. Therefore, the thickness of the intermediate transfer belt 31 is preferably controlled to fall in the preferable rang mentioned above. Particularly, when the thickness falls in the even more preferable range, the intermediate transfer belt 31 has excellent durability.

In order to enhance the running stability of the intermediate transfer belt 31, the unevenness of the thickness of the base layer 31*a* is preferably as little as possible. The method for preparing an even base layer is not particularly limited, and a proper method is selected from known methods. The thickness of the base layer 31*a* can be measured by a thickness gauge such as a contact-type thickness gauge and an eddy current-type thickness gauge or a method in which the cross section of the base layer is observed with a scanning electron microscope (SEM).

The surface of the elastic layer 31*b* is roughened because the dispersed particulate material projects from the surface. Suitable materials for use in forming the elastic layer 31*b* include general-purpose resins, elastomers and rubbers. Since elastic materials having good elasticity are preferably used for the elastic layer 31*b*, elastomers and rubbers are preferably used therefor. Specific examples of such elastomers include polyester elastomers, polyamide elastomers, polyether elastomers, polyurethane elastomers, polyolefin elastomers, polystyrene elastomers, acrylic elastomers, polydiene elastomers, and silicone-modified polycarbonate elastomers. Thermoplastic elastomers such as fluorine-containing copolymers can also be used. In addition, thermosetting resins such as polyurethane resins, silicone-modified epoxy resins, and silicone-modified acrylic resins can also be used. Specific examples of the rubbers include isoprene rubbers, styrene rubbers, butadiene rubbers, nitrile rubbers, ethylene-propylene rubbers, butyl rubbers, silicone rubbers, chloroprene rubbers, acrylic rubbers, chlorosulfonated polyethylene, fluorine-containing rubbers, urethane rubbers, and hydrin rubbers. By properly selecting one or more materials from these materials, an elastic layer having the desired properties can be prepared. In order that the elastic layer 31*b* can follow the rough surface of a rough recording sheet such as REZAKKU PAPER, it is preferable to use a material being as soft as possible for the elastic layer. In addition, since the particulate material 31*c* is dispersed in the elastic layer 31*b*, it is more preferable to use a thermosetting material than a thermoplastic material. The reason therefor is that the number of functional groups included in a thermosetting material is greater than that in a thermoplastic material because the functional groups are used for the hardening reaction of the material, and therefore the material has good adhesiveness with a particulate material such as resin particles. For the same reason, vulcanizing rubbers can also be preferably used.

Among the elastic materials for use in forming the elastic layer 31*b*, acrylic rubbers are more preferable from the viewpoints of resistance to ozone, flexibility, adhesiveness with particulate materials, resistance to fire, and stability to withstand environmental conditions. The acrylic rubber used for the elastic layer 31*b* is not particularly limited, and for example marketed products thereof can be used. Among the groups used for crosslinking acrylic rubbers (such as epoxy groups, active chlorine-containing groups, and carboxyl groups), carboxyl groups are more preferable because the acrylic rubbers have good processability and the resultant crosslinked acrylic rubbers have good rubber properties (such as compression set). Amine compounds are preferably used as the crosslinking agent for crosslinking acrylic rubbers having a carboxyl group, and polyamine compounds such as aliphatic polyamine type crosslinking agents and aromatic polyamine type crosslinking agents are more preferably used. Specific examples of the aliphatic polyamine type crosslinking agents include hexamethylenediamine, hexamethylenediamine carbamate, and N,N'-dicinnamylidene-1,6-hexanediamine. Specific examples of the aromatic polyamine type crosslinking agents include 4,4'-methylenedianiline, m-phenylenediamine, 4,4'-diaminodiphenyl ether, 3,4'-diaminodiphenyl ether, 4,4'-(m-phenylenediisopropylidene)dianiline, 4,4'-(p-phenylenediisopropylidene) dianiline, 2,2'-bis[4-(4-aminophenoxy)phenyl]propane, 4,4'-diaminobenzanilide, 4,4'-bis(4-aminophenoxy)biphenyl, m-xylylenediamine, p-xylylenediamine, 1,3,5-benzentriamine, and 1,3,5-benzenetriaminomethyl.

The added amount of such a crosslinking agent is preferably from 0.05 to 20 parts by weight, and more preferably from 0.1 to 5 parts by weight, based on 100 parts by weight of an acrylic rubber. When the added amount is too small, the crosslinking reaction is not sufficiently performed, and therefore the crosslinked acrylic rubber cannot have good shape retention property. In contrast, when the added amount is too large, the crosslinked acrylic rubber becomes too hard, and therefore elasticity of the rubber deteriorates.

When an acrylic rubber is used for forming the elastic layer 31*b*, a crosslinking accelerator to accelerate the crosslinking reaction of the acrylic rubber with a crosslinking agent can be used. The crosslinking accelerator is not particularly limited, but materials which can be used in combination with such polyamine crosslinking agents as mentioned above are preferable. Suitable materials for use as the crosslinking accelerators include guanidine compounds, imidazole compounds, quaternary onium salts, tertiary polyamine compounds, tertiary phosphine compounds, and alkali metal salts of weak acids. Specific examples of the guanidine compounds include 1,3-diphenylguanidine, and 1,3-di-o-tolylguanidine. Specific examples of the imidazole compounds include 2-methylimidazole, and 2-phenylimidazole. Specific examples of the quaternary onium salts include tetra-n-butylammonium bromide, and octadecyltri-n-butylammonium bromide. Specific examples of the tertiary polyamine compounds include triethylenediamine, and 1,8-diazabicyclo[5.4.0]undecene-7 (DBU). Specific examples of the tertiary phosphine compounds include triphenylphosphine, and tri-p-tolylphosphine. Specific examples of the alkali metal salts of weak acids include salts of weak inorganic acids such as sodium or potassium salts of phosphoric acid, and carbonic acid, and salts of weak organic acids such as sodium or potassium salts of stearic acid, and salts of lauric acid.

The added amount of such a crosslinking accelerator is preferably from 0.1 to 20 parts by weight, and more preferably from 0.3 to 10 parts by weight, based on 100 parts by weight of an acrylic rubber. When the added amount is too large, problems such that the crosslinking reaction is not performed too fast; bloom of the crosslinking accelerator is formed on the surface of the crosslinked material; and the crosslinked material becomes too hard tend to occur. In contrast, when the added amount is too small, problems such that the tensile strength of the crosslinked material deteriorates; and change of elongation rate and tensile strength of the crosslinked material seriously increases after the crosslinked material receives heat load tend to occur.

When an acrylic rubber is prepared, a mixing method such as roll mixing, BUMBURY mixing, screw mixing, and solution mixing can be used. The mixing order is not particularly limited, but it is preferable to use, for example, a mixing method in which components which are hardly decomposed when heated are initially mixed, and then components (such as crosslinking agents) which are reactive or easily decomposed by heat are mixed therewith at a temperature lower than the reaction temperature or the decomposition temperature can be used.

Such an acrylic rubber is heated to be crosslinked. The heating temperature is preferably from 130 to 220° C., and more preferably from 140 to 200° C. The crosslinking time is preferably from 30 seconds to 5 hours. Specific examples of the heating method include methods for use in crosslinking rubbers such as press heating methods, steam heating methods, oven heating methods, and hot air heating methods. In addition, after the crosslinking operation is performed, the crosslinked material may be subjected to a post-crosslinking operation to completely crosslink the inner portion of the crosslinked material. The post-crosslinking time changes depending on the heating method, heating temperature, and shape of the crosslinked material, and is preferably from 1 hour to 48 hours. The heating method and the heating temperature in the post-crosslinking operation are not particularly limited, and are properly selected from any known heating methods and heating temperatures. In order to adjust the electric properties and other properties of the crosslinked material, electric resistance controlling agents, and flame retardants can be mixed with the raw materials of the crosslinked material. In addition, additives such as antioxidants, reinforcing agents, and fillers can be optionally mixed with the raw materials of the crosslinked material if desired. Specific examples of the electric resistance controlling agents include the materials mentioned above for use in the base layer 31*a*. In this regard, since carbon black and metal oxides tend to deteriorate flexibility of the crosslinked material, the added amount thereof is preferably as small as possible. It is preferable to use an ionic electroconductive agent or an electroconductive polymer. These electric resistance controlling agents can be used alone or in combination.

It is preferable to add a perchlorate or an ionic liquid in an amount of from 0.01 to 3 parts by weight based on 100 parts by weight of a rubber. When the added amount of such an ionic electroconductive agent is less than 0.01 parts by weight, the electric resistance decreasing effect cannot be sufficiently produced. In contrast, when the added amount is greater than 3 parts by weight, a problem in that the ionic electroconductive agent blooms or bleeds on the surface of the resultant belt tends to occur.

The added amount of the electric resistance controlling agent is preferably controlled so that the resultant elastic layer has a surface resistivity of from $1\times10^{8}$ to $1\times10^{13}\Omega/\square$, and a volume resistivity of from $1\times10^{6}$ to $1\times10^{12}$ Ω·cm. In addition, in order to satisfy a requirement for recent electrophotographic image forming apparatus, i.e., in order that the elastic layer has an ability of transferring toner to recording sheets having rough surface, it is preferable to adjust the flexibility of the elastic layer 31*b* such that the layer has a micro rubber hardness of not greater than 35 under an environmental condition of 23° c. and 50% RH. In this regard, the microhardness measuring methods such as Martens hardness measuring method and Vickers hardness measuring method are not preferable because only a small (shallow) surface area of the sample in the depth (bulk) direction is measured by the methods, and therefore deformation property of entirety of the belt cannot be evaluated. For example, when an outermost layer is formed on a base layer having poor deformation property using a flexible material to form a belt, the belt has a low microhardness but cannot be used as the intermediate transfer belt 31 because of having poor deformation property. Namely, the belt cannot follow a recording sheet having rough surface, and toner images on the belt cannot be satisfactorily transferred to the rough recording sheet, i.e., the requirement for the recent electrophotographic image forming apparatus cannot be satisfied. Therefore, it is preferable to measure the micro rubber hardness of the intermediate transfer belt to properly evaluate the deformation property of the intermediate transfer belt.

The thickness of the elastic layer 31*b* is preferably from 200 μm to 2 mm, and more preferably from 400 μm to 1000 μm. When the thickness of the elastic layer 31*b* is less than 200 μm, problems such that the property of the belt to follow recording sheets having rough surface deteriorates; and the transfer pressure decreasing effect cannot be satisfactorily produced by the belt tend to occur. In contrast, when the thickness is greater than 2 mm, problems such that the intermediate transfer belt tends to be bent due to gravity of the elastic layer 31*b*, and thereby the belt is rotated unevenly; and the belt is cracked by the rollers over which the belt is looped tend to occur. The thickness of the elastic layer 31*b* is measured by observing the cross section of the belt with a scanning electron microscope (SEM).

Particulate resins which have an average particle diameter of not greater than 100 μm and a spherical form and which are insoluble in organic solvents while having a 3% heat decomposition temperature of not lower than 200° C. are preferably used for the particulate material 31*c* to be dispersed in the elastic layer 31*b*. The resin material of the particulate material 31*c* is not particularly limited, and specific examples thereof include acrylic resins, melamine resins, polyamide resins, polyester resins, silicone resins, fluorine-containing resins, and rubbers. These particulate resins may be subjected to a surface treatment using a different material. Spherical rubbers which serve as a mother particulate material and whose surface is coated with a hard resin can be used as the particulate resin. In addition, hollow particles and porous particles can also be used as the mother particulate material.

Among such particulate resins as mentioned above, particulate silicone resins are more preferable because of having a good combination of lubricating property, releasability from toner, and abrasion resistance. In addition, spherical resins prepared by a polymerization method are preferable, and it is better for the particulate resins to have a form closer to the true spherical form. The particulate material 31*c* preferably has a volume average particle diameter of from 1.0 μm to 5.0 μm while having a monodisperse particle diameter distribution. In this regard, a particulate material with a monodisperse particle diameter does not mean a particulate material having a single particle diameter and means a particulate material having a sharp particle diameter distribution, specifically, a particulate material having a particle diameter distribution of from [A−Ax0.5] μm to [A+Ax0.5] μm, wherein A represents the average particle diameter. When the volume average particle diameter of the particulate material 31*c* is less than 1.0 μm, the particulate material cannot impart good toner transferring property to the intermediate transfer belt 31. In contrast, when the volume average particle diameter is greater than 5.0 μm, the interval between adjacent particles on the elastic layer 31*b* seriously increases, thereby seriously roughening the surface of the elastic layer, resulting in occurrence of problems in that toner images on the intermediate transfer belt 31 cannot be satisfactorily transferred to a recoding sheet; and toner remaining on the intermediate transfer belt cannot be satisfactorily removed by a cleaner. In addition, since particulate resins used as the particulate material generally have a high insulating property, the particulate material 31*c* has a large charge when the particle diameter thereof is too large, thereby easily causing a problem in that abnormal images are formed when the printing operation is continuously performed due to accumulation of the charge.

The method for preparing the particulate material 31*c* is not particularly limited, and specially-synthesized particulate resins or marketed particulate resins can be used therefor. The elastic layer 31*b* can be formed, for example, by directly applying particles of the particulate material 31*c* on the resin layer of the elastic layer and then smoothing the particles so that the particles are arranged in good order in the surface direction of the elastic layer. By using this method, occurrence of a problem in that plural particles are overlaid in the thickness direction of the elastic layer 31*b* can be prevented. The diameters of cross sections of particles of the particulate material 31*c* located on the surface of the elastic layer 31*b* are preferably as even as possible, and the diameters preferably have a distribution of from [A−Ax0.5] μm to [A+Ax0.5] μm, wherein A represents the average particle diameter. Therefore, it is preferable to use a particulate material having a narrow (sharp) particulate diameter distribution for the particulate material 31*c*. However, by using the particle application method mentioned above, a particulate material having a relatively wide particle diameter distribution can be used for the particulate material 31*c*. The time at which the particulate material is applied on the surface of the elastic layer 31*b* is not particularly limited, and can be before or after the cross-linking operation of the elastic material of the elastic layer.

The ratio of the surface area of the elastic layer 31*b* in which the particulate material 31*c* is present to the surface area in which the particulate material is not present (i.e., the elastic material of the elastic layer is exposed) is preferably not less than 0.6 (60%). When the ratio is less than 0.6, the chance of contact of the elastic material with toner is increased, thereby causing problems in that toner images on the intermediate transfer belt 31 cannot be satisfactorily transferred to a recording sheet; toner remaining on the intermediate transfer belt cannot be satisfactorily removed therefrom; and a toner film is formed on the intermediate transfer belt.

It is possible to use an elastic layer including no particulate material 31*c* for the elastic layer 31*b*.

Figure 5:
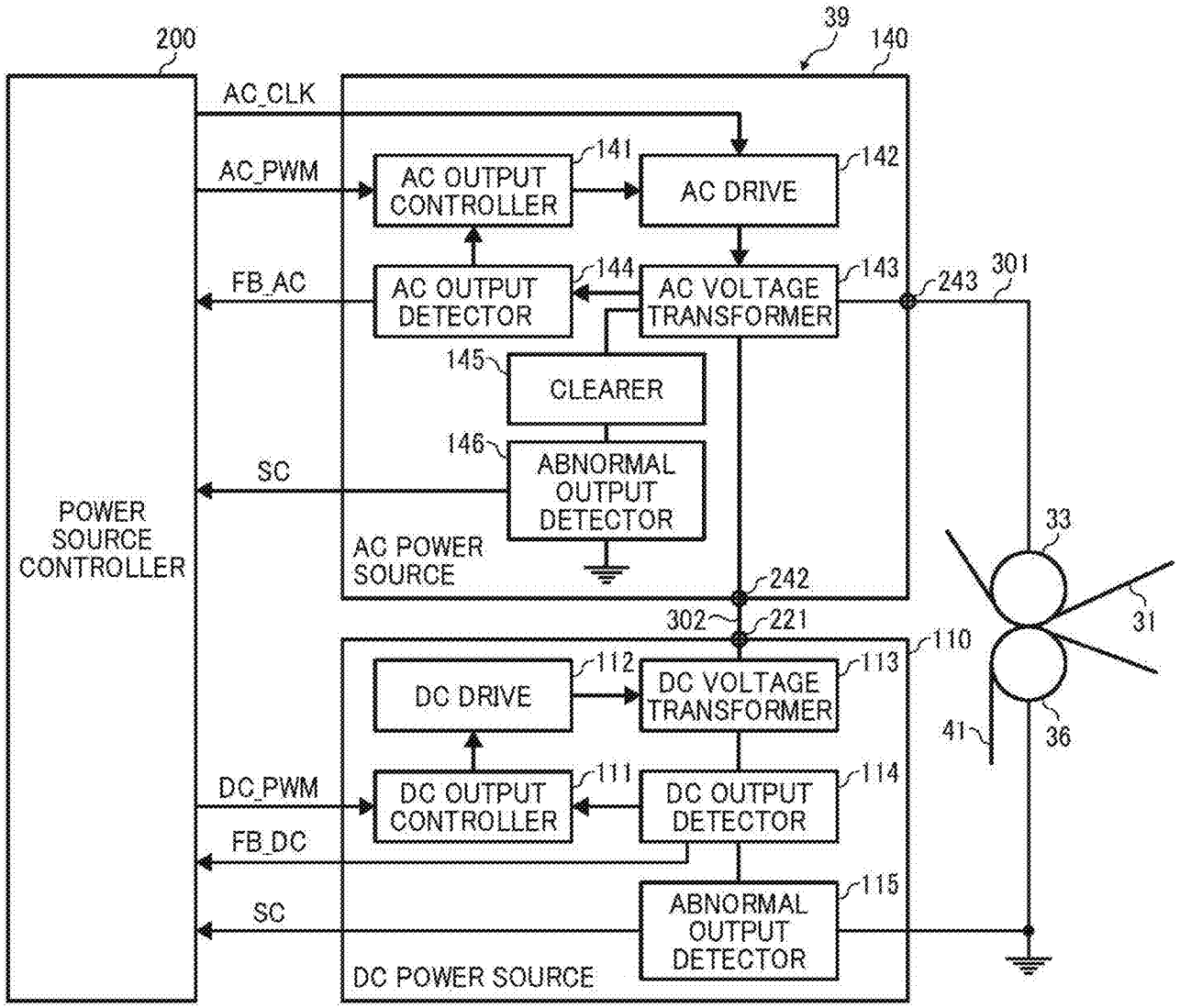
FIG. 5 is a block diagram illustrating a secondary transfer power source of the printer together with a secondary transfer bias roller and a secondary transfer ground roller.

FIG. 5 is a block diagram illustrating the main portion of the secondary transfer power source 39 of the printer together with the secondary transfer bias roller 33 and the secondary transfer ground roller 36. The secondary transfer power source 39 includes a DC power source 110, an AC power source 140 detachably attachable to the printer, and a power source controller 200. The DC power source 110 outputs a DC voltage to apply an electrostatic force having a direction of from the intermediate transfer belt 31 to the recording sheet to the toner on the surface of the intermediate transfer belt. The DC power source 110 includes a DC output controller 111, a DC drive 112, a DC voltage transformer 113, a DC output detector 114, an abnormal output detector 115, and an electric connector 221.

The AC power source 140 outputs an AC voltage to be superimposed on the DC voltage mentioned above, and includes an AC output controller 141, an AC drive 142, an AC voltage transformer 143, an AC output detector 144, a clearer 145, an abnormal output detector 146, an electric connector 242, and another electric connector 243.

The power source controller 200 controls the DC power source 110 and the AC power source 140, and is a controller including a central processing unit (CPU), a read only memory (ROM), and a random access memory (RAM). The power source controller 200 inputs a DC_PWM signal to control the magnitude of the DC voltage to the DC output controller 111. In addition, the output from the DC voltage transformer 113, which is detected by the DC output detector 114, is also input to the DC output controller 111. The DC output controller 111 performs the following control based on the duty ratio of the DC_PWM signal input, and the output from the DC voltage transformer 113. Specifically, the DC output controller 111 performs a control such that drive of the DC voltage transformer 113 is controlled via the DC drive 112 so that the value of output from the DC voltage transformer 113 becomes equal to the output value indicated by the DC_PWM signal.

The DC drive 112 drives the DC voltage transformer 113 based on the control of the DC output controller 111 to output a negative DC high voltage. When the AC power source 140 is not connected, the electric connector 221 is electrically connected with the secondary transfer bias roller 33 via a harness 301, and therefore the DC voltage transformer 113 outputs (i.e., applies) a DC voltage to the secondary transfer bias roller 33 via the harness 301. In contrast, when the AC power source 140 is connected, the electric connector 221 is electrically connected with the electric connector 242 via a harness 302, and therefore the DC voltage transformer 113 outputs a DC voltage to the AC power source 140 via the harness 302.

The DC output detector 114 detects the value of a DC high voltage output from the DC voltage transformer 113 and inputs the output value to DC output controller 111. In addition, the DC output detector 114 outputs the detected output value to the power source controller 200 as a FB_DC signal so that the power source controller 200 can control the duty of the DC_PWM signal to prevent the transferring property of toner images from deteriorating due to change of environmental conditions and load. In this printer, the AC power source 140 can be detachably attachable to the main body of the secondary transfer power source 39, the impedance of the high voltage output path varies depending on the presence or absence of the AC power source 140. Therefore, when the DC power source 110 outputs a DC voltage by performing a constant voltage control, the partial pressure ratio changes due to change of impedance of the output path depending on the presence or absence of the AC power source 140. In addition, the high voltage applied to the secondary transfer bias roller 33 also changes, thereby changing the transferability of toner images depending on the presence or absence of the AC power source 140.

Therefore, in this printer, the DC power source 110 outputs a DC voltage by performing a constant current control, and changes the output voltage depending on the presence or absence of the AC power source 140. Therefore, even when the impedance of the output path changes, the high voltage applied to the secondary transfer bias roller 33 can be maintained so as to be constant, thereby making it possible to maintain good toner transferability in spite of the presence or absence of the AC power source 140. In addition, it can be possible to detach or attach the AC power source 140 without changing the value of the DC_PWM signal. Thus, in this printer, the DC power source performs a constant current control. However, the printer can use a control method in which the DC power source 110 performs a constant voltage control and in addition the DC_PWM signal is changed when the AC power source 140 is detached or attached so that the high voltage applied to the secondary bias roller 33 is maintained at a constant voltage.

The abnormal output detector 115 is arranged on an output line of the DC power source 110, and outputs a SC signal indicating abnormal output such as leakage to the power source controller 200 when abnormal output is caused due to earth fault, thereby making it possible for the power source controller 200 to perform a control of stopping output of a high voltage from the DC power source.

The AC output controller 141 receives an AC_PWM signal which is output from the power source controller 200 to control the magnitude of output of the AC voltage, and information on the value of output from the AC voltage transformer 143 detected by the AC output detector 144.

Based on the duty ratio of the input AC_PWM signal and the value of output from the AC voltage transformer 143, the AC output controller 141 performs a control such that the AC drive 142 drives the AC voltage transformer 143 so that the value of output from the AC voltage transformer 143 becomes the output value indicated by the AC_PWM signal.

An AC_CLK signal to control the frequency of the output AC voltage is input to the AC drive 142. Since the AC drive 142 drives the AC voltage transformer 143 based on a control signal and the AC_CLK signal, which are output from the AC output controller 141, the AC drive can control the wave form of the AC voltage output from the AC voltage transformer 143 at the frequency indicated by the AC_CLK signal.

The Ac voltage transformer 143 generates an AC voltage by being driven by the AC drive 142, and generates an AC and DC superimposition voltage in which the generated AC voltage is superimposed on the DC high voltage output from the DC voltage transformer 113. When the AC power source 140 is connected, i.e., when the electric connector 243 is electrically connected with the secondary transfer bias roller 33 via the harness 301, the AC voltage transformer 143 applied the AC and DC superimposition voltage to the secondary transfer bias roller 33 via the harness 301. When the AC voltage transformer 143 does not generate the AC voltage, the AC voltage transformer outputs (i.e., applies) the DC high voltage output from the DC voltage transformer 113 to the secondary transfer bias roller 33. The voltage (AC and DC superimposition voltage or DC voltage) output to the secondary transfer bias roller 33 is returned to the DC power source 110 via the secondary transfer ground roller 36.

The AC output detector 144 detects the value of the AC voltage output from the AC voltage transformer 143, and outputs the value to the AC output controller 141 while outputting the value to the power source controller 200 as a FB_AC signal (feedback signal). The power source controller 200 controls the duty of the AC_PWM signal based on the value not to deteriorate the transferability due to change of the environmental conditions and load. Although the AC power source 140 performs a constant voltage control, the AC power source may perform a constant current control. The wave form of the AC voltage generated by the AC voltage transformer 143 (AC power source 140) may be a sine wave or a rectangular wave, and a short-pulse type rectangular wave is used in this printer because the image quality can be enhanced thereby.

Figure 6:
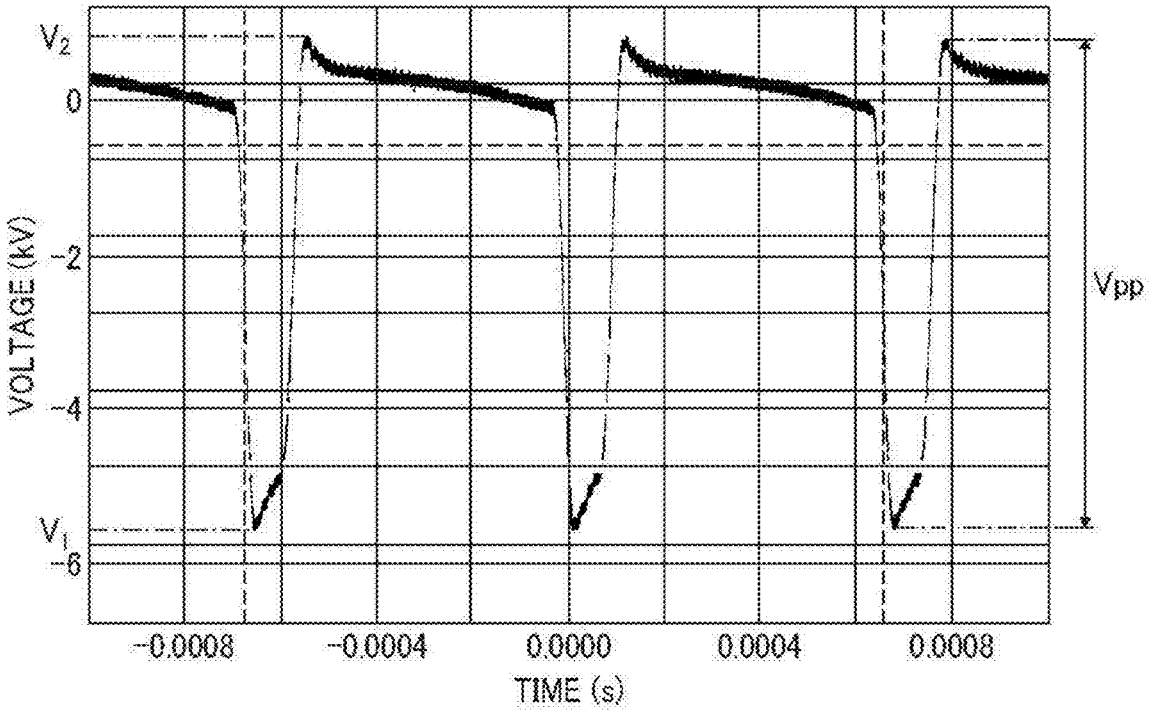
FIG. 6 is a graph illustrating the characteristic curve of a secondary transfer bias in the printer.

The K toner used for the printer includes carbon black. When a K toner image or a color toner image including a K toner image is formed (i.e., when the printer is in a color print mode), a secondary transfer bias having such a property as illustrated in FIG. 6 is applied to the secondary transfer bias roller 33, which serves as a transfer bias member and which is present inside the loop of the intermediate transfer belt 31. In the printer having such a configuration, when the secondary transfer bias has a negative polarity like the toner, the toner is electrostatically moved from the intermediate transfer belt 31 to the recoding sheet at the secondary transfer nip.

In FIG. 6, Vpp represents a peak-to-peak value of the AC component of the AC and DC superimposition voltage. In addition, a first peak $V_1$ is a peak at which the electrostatic force by which the toner is moved from the intermediate transfer belt to the recording sheet at the secondary transfer nip is increased. A second peak $V_2$ is a peak at which the electrostatic force by which the toner is moved from the recording sheet to the intermediate transfer belt at the secondary transfer nip is increased.

When an AC and DC superimposition voltage is applied as the secondary transfer bias, the amount of opposite charge (i.e., positive charge in this printer) injected into the toner at the secondary transfer nip can be decreased so as to be lower than in a case in which only a DC voltage is applied as the secondary transfer bias, thereby preventing occurrence of a problem in that secondary transferring of a toner image is defectively performed because the toner has the opposite charge or a weak charge. Particularly, when a sheet such as coated paper having a coat layer thereon and plain paper, which have a relatively high smoothness, is used as the recording sheet P, the defective transferring problem mentioned above tends to be easily caused, and therefore it is effective to apply such an AC and DC superimposition voltage as mentioned above.

When a recording sheet having a rough surface such as Japan paper is used as the recording sheet P, a toner image cannot be satisfactorily transferred to concave portions of the recording sheet, thereby forming an uneven toner image on the recording sheet. However, since the intermediate transfer belt 31 of this printer has the elastic layer 31*b* as the outermost layer, a toner image can be satisfactorily transferred to concave portions of such a rough recording sheet, and therefore formation of an uneven toner image can be prevented. Specifically, the elastic layer 31*b* deforms so as to be contacted with concave portions and convex portions at the secondary transfer nip, and therefore a toner image on the elastic layer can be satisfactorily transferred to the rough recording sheet.

Figure 7:
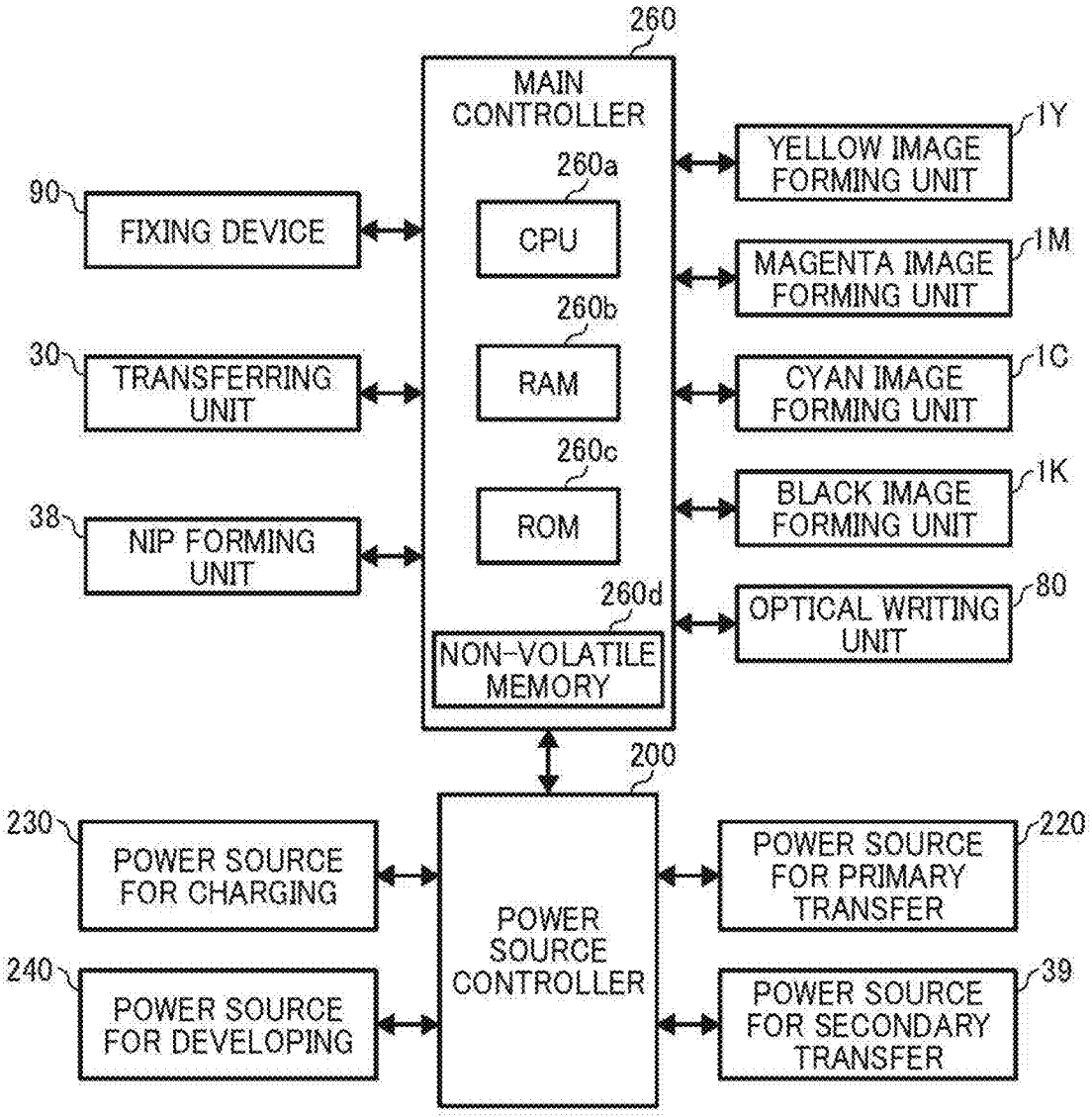
FIG. 7 is a block diagram illustrating the main portion of an electric circuit of the printer.

FIG. 7 is a block diagram illustrating the main portion of the electric circuit of this printer. As illustrated in FIG. 7, a main controller 260 is connected with the image forming units 1Y, 1M, 1C and 1K, the optical writing unit 80, the fixing device 90, the transferring unit 30, the nip forming unit 38, and the power source controller 200.

The power source controller 200 is connected with a power source for primary transfer (hereinafter primary transfer power source) 220, the secondary transfer power source 39, a power source for charging (hereinafter charging power source) 230 and a power source for developing (hereinafter developing power source) 240. The primary transfer power source 220 outputs a primary transfer bias to be applied to each of the primary transfer rollers 35Y, 35M, 35C and 35K, and the power source controller 200 can control each of the primary transfer biases. The charging power source 230 outputs a charge bias to be applied to each of the charging rollers 7Y, 7M, 7C and 7K, and the power source controller 200 can control each of the charge biases. The developing power source 240 outputs a development bias to be applied to each of the developing rollers 9 (such as the K developing roller 9K), and the power source controller 200 can control each of the development biases.

The main controller 260 includes a central processing unit (CPU) 260*a* to execute an arithmetic processing and various programs, a random access memory (RAM) 260*b* to store data, a read only memory (ROM) 260*c*, and a nonvolatile memory 260*d*. If necessary, the main controller 260 performs a toner density target value correction processing and a compulsory toner consumption processing in a continuous printing operation in which plural prints are continuously produced.

In the developing devices 8Y, 8M, 8C and 8K, when Y, M, C and K images having a relatively high average image area ratio are produced in a continuous printing operation, the toner residence time defined as a period from supply of the toner to the developing device to consumption of the toner for development is relatively short. In this case, the toner stirring time becomes short, and thereby the charge quantity Q/M of the toner is decreased. Therefore, the electrostatic attraction between the toner particles and the developing roller decreases, resulting in enhancement of the developing ability, thereby increasing the image density. In contrast, when images having a relatively low average image area ratio are continuously produced, the toner residence time is relatively long. In this case, the toner stirring time becomes long, and thereby the charge quantity Q/M of the toner is increased. Therefore, the electrostatic attraction between the toner particles and the developing roller increases, resulting in weakening of the developing ability, thereby decreasing the image density.

The toner density target value correction processing is performed to prevent variation of image density due to variation of the charge quantity Q/M of the toner. The toner density target value correction processing is performed every ten prints in a continuous printing operation. Every ten prints, the main controller 260 forms four Y, M, C and K test toner images arranged in the first direction (i.e., the main scanning direction or the width direction of the belt) in a non-image area (hereinafter inter-sheet area) of the intermediate transfer belt 31, which is an area between two adjacent toner images to be transferred to two recording sheets, which are arranged in the second direction (i.e., the sub-scanning direction or the belt moving direction).

The inter-sheet area is an area between an area of the intermediate transfer belt 31 to be contacted with a first recording sheet P at the secondary transfer nip to transfer a first toner image thereto and an area of the intermediate transfer belt to be contacted with a second recording sheet P at the secondary transfer nip to transfer a second toner image thereto. By forming the test toner images in the inter-sheet area, occurrence of a problem in that the first and second recording sheets are soiled with the test toner images can be prevented. In this regard, each of the four test toner images is a solid image.

The Y, M, C and K test toner images formed in the inter-sheet area of the intermediate transfer belt 31 are not contacted with the recording sheet P at the secondary transfer nip, and are transferred to the nip forming belt 41. Since the nip forming belt 41 is rotated, the test toner images on the nip forming belt are moved to a position at which the test toner images face the optical sensor unit 40, and the reflection type photosensor of the optical sensor unit detects the amount of toner of the test toner image. In order to detect the amounts of toner of the for test toner images at the same time, the optical sensor unit 40 has four reflection type photosensors arranged in the first direction (i.e., the main scanning direction).

When the main controller 260 receives the detection results of the toner amounts of the test toner images from the optical sensor unit 40, the main controller 260 corrects the toner density target value based on the difference between the target value (i.e., the target image density) and the detection results so that toner images having a target image density can be produced. This toner density target value correction processing is performed for each of Y, M, C and K toner images.

When the average image area ratio of Y, M, C and K images decreases and thereby the toner residence time of the developing devices 8Y, 8M, 8C and 8K is increased in a continuous printing operation, a problem in that the external additive of the toner is embedded into or released from toner particles due to excessive stirring in the developing devices, resulting in increase of amount of deteriorated toner particles. Since such deteriorated toner particles adversely affect the image density, it is preferable to remove such deteriorated toner particles from the developing devices. Therefore, if necessary, the main controller 260 performs the compulsory toner consumption processing every one print in a continuous printing operation to remove such deteriorated toner particles from the developing devices.

The compulsory toner consumption processing is performed for each of Y, M, C and K images. Specifically, the image area ratio of one developed toner image (hereinafter one print image area ratio) is calculated, and the one print image area ratio is subtracted from a predetermined threshold value of the one print image area ratio, wherein the difference is the amount of toner necessary for compulsory toner consumption processing (hereinafter necessary toner compulsory consumption amount). When the one print image area ratio is greater than the threshold value, the necessary toner compulsory consumption amount is a negative value. Namely, in this case, a relatively large amount of toner is used for development, and therefore deteriorated toner particles tend to be discharged from the developing devices. Therefore, demand for the compulsory toner consumption processing decreases, and the necessary toner compulsory consumption amount has a negative value. In contrast, when the one print image area ratio is less than the threshold value, a relatively small amount of toner is used for development, and therefore the amount of deteriorated toner particles increases, and therefore the demand for the compulsory toner consumption processing increases. Therefore, the necessary toner compulsory consumption amount has a positive value.

After the necessary toner compulsory consumption amount is calculated for each of Y, M, C and K images, the necessary toner compulsory consumption amount is added to a necessary toner compulsory consumption cumulative amount which is a total of the previous necessary toner compulsory consumption amounts to update the necessary toner compulsory consumption cumulative amount for each color toner. When the updated necessary toner compulsory consumption cumulative amount of a color toner exceeds a predetermined threshold value of the necessary toner compulsory consumption cumulative amount, it is necessary to perform the compulsory toner consumption processing on the developing device forming the color toner image. If it is necessary to perform the compulsory toner consumption processing on any one of the developing devices 8Y, 8M, 8C and 8K, compulsory consumption toner images of the color toner are formed in the inter-sheet area of the intermediate transfer belt 31 to perform compulsory toner consumption. However, when the test toner images are to be formed to perform the toner density correction processing, formation of the test toner image has priority over formation of the compulsory consumption toner image, and therefore the compulsory consumption toner image is formed on the next inter-sheet area of the intermediate transfer belt 31.

When the compulsory consumption toner image is formed, the main controller 260 calculates the amount of toner compulsorily consumed based on the area of the compulsory consumption toner image, followed by subtracting the amount from the necessary toner compulsory consumption cumulative amount to update the cumulative amount. The main controller 260 performs this processing for each of the developing devices 8Y, 8M, 8C and 8K.

The second belt cleaner 43 has a maximum cleaning ability to remove toner of an image having an image area ratio of 200% from the nip forming belt 41 In this regard, the image area ratio is determined by the following equation:

$$\text{Image area ratio (\%)}=\{(Y+M+C+K)/A\}\times 100,$$

wherein Y, M, C and K represent the areas of the Y, M, C and K dot images formed in the inter-sheet area, and A represents the effective area of the inter-sheet area.

Specifically, when a Y solid toner image is formed on the entire inter-sheet area, the Y solid image has an image area ratio of 100%. When a M solid toner image is formed on the Y toner image, the YM combination solid image has an image area ratio of 200%. When a halftone image having a dot area ratio of 50% is formed on the entire inter-sheet area, the image has an image area ratio of 50%.

If four compulsory consumption toner images (i.e., Y, M, C and K toner images) can be formed while overlaid unlike the image forming apparatus described in JP-4998245-B in which two compulsory consumption toner images each including two overlaid toner images are arranged side by side in the sub-scanning direction, the compulsory toner consumption efficiency can be enhanced. However, in this case, it is necessary to use a cleaner having a high cleanability to remove such four compulsory consumption toner images including a large amount of toners from the belt. The function of general belt cleaners is to remove a small amount of toner (i.e., residual toner) from a belt, and therefore such belt cleaners are not required to have such a high cleanability. Therefore, when a cleaner having such a high cleanability is used, costs of the image forming apparatus seriously increases.

The reason why the image forming apparatus described in JP-4998245-B forms two compulsory consumption toner images each including two overlaid toner images is considered to be that the amount of toners to be cleaned can fall in a certain range in consideration of the amount of toners which can be removed by a cleaner. If such two compulsory consumption toner images are formed side by side in an inter-sheet without a space therebetween (i.e., if compulsory consumption toner images having a wide area are formed), the amount of compulsory consumption toners can be increased, thereby enhancing the compulsory toner consumption efficiency. However, in this case it is possible that the compulsory consumption toner image includes a toner image in which three or four toner images are overlaid, for example, due to positional variation of the two pieces of two overlaid toner images. In this case, an excess burden is placed on the cleaner when removing the overlaid three or four toner images, thereby causing problems in that a portion of the cleaner contacting the three or four overlaid compulsory toner images is damaged; and defective cleaning occurs. Therefore, it is necessary to form such two pieces of overlaid two compulsory consumption toner images with a certain space therebetween so that even when positions of the two pieces of overlaid two compulsory consumption toner images vary, the two pieces of overlaid two compulsory consumption toner images are not overlapped. Since two pieces of overlaid two compulsory consumption toner images are formed with such a certain space therebetween in the image forming apparatus described in JP-4998245-B, the compulsory toner consumption efficiency deteriorates.

Next, the feature of the printer according to an embodiment of this disclosure will be described.

Figure 8:
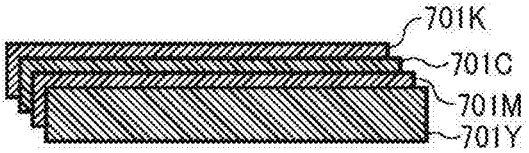
FIG. 8 is a schematic view illustrating a combined toner image in which four halftone toner images each having a dot area ratio of 50% are overlaid.

As illustrated in FIG. 8, when a Y halftone toner image 701Y having a dot area ratio of 50%, a M halftone toner image 701M having a dot area ratio of 50%, a C halftone toner image 701C having a dot area ratio of 50%, and a K halftone toner image 701K having a dot area ratio of 50% are overlaid, the combined Y, M, C and K toner image has an image area ratio of 200%. Therefore, the second belt cleaner 43 can remove the combined Y, M, C and K toner image without problem. However, the present inventors discover that the combined Y, M, C and K toner image cannot be satisfactorily transferred to the nip forming belt 41 and a large amount of toner remains on the intermediate transfer belt 31, thereby often causing the toner re-adhesion problem mentioned above.

The reason why a large amount of toner remains on the intermediate transfer belt 31 is considered to be the following. Specifically, in the Y halftone toner image 701Y having a dot area ratio of 50%, the area ratio of the white area to the Y toner image area is 1/1. If the M halftone toner image 701M having a dot area ratio of 50% can be formed on the white area of the Y halftone toner image, the Y and M halftone toner images are not overlaid, and a solid toner image including the Y and M halftone toner images is formed. However, it is technically difficult to form such Y and M halftone toner images while precisely controlling the positions of the halftone toner images, and a large number of overlaid Y and M dot toner images are formed. Therefore, the combined Y, M, C and K toner image illustrated in FIG. 8 may include a significant number of overlaid Y, M, C and K dot toner images while including a significant number of white areas. Therefore, the amount of toner in the toner images varies in the surface direction of the intermediate transfer belt 31, and a large amount of toner remains on the intermediate transfer belt even after the secondary transfer process.

Figure 9:
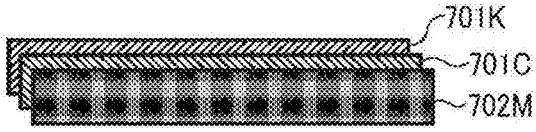
FIG. 9 is a schematic view illustrating a combined toner image in which two halftone toner images each having a dot area ratio of 50% and a solid toner image having a dot area ratio of 100% are overlaid.

Referring to FIG. 9, when a solid toner image having a dot area ratio of 100% (a M toner image 702M in FIG. 9), and two halftone toner images (C and K halftone toner images 701C and 701K in FIG. 9) are overlaid, the toner re-adhesion problem is often caused. This combined M, C and K toner image has no white area, but has single dot portions in which only one dot toner image is formed, double image portions in which two dot toner image are overlaid, and triple dot image portions in which three dot toner images are overlaid due to variation of positions of the C and K dot toner images. Although the variation in the amount of toner in this combined M, C and K toner image is less than that in the combined Y, M, C and K toner image illustrated in FIG. 8, variation in the amount of toner is relatively large in the surface direction of the intermediate transfer belt 31, and a relatively large amount of toner remains on the intermediate transfer belt even after the secondary transfer process.

Figure 10:
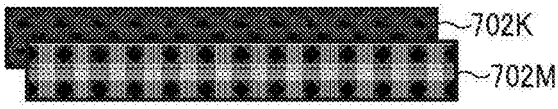
FIG. 10 is a schematic view illustrating a combined toner image in which two solid toner images each having a dot area ratio of 100% are overlaid.

In a combined toner image illustrated in FIG. 10 in which two solid image each having a dot area ratio of 100% (M and K solid toner images 702M and 702K in FIG. 10) are overlaid, almost all the dot images are double dot images in which two dot images are overlaid. Therefore, the amount of toner is even in the surface direction of the intermediate transfer belt 31, and only a little amount of toner remains on the intermediate transfer belt after the secondary transfer process. Therefore, the toner re-adhesion problem is not caused.

In order to prevent occurrence of a problem in that the amount of deteriorated toners seriously increases in any one of the Y, M, C and K toners in the developing devices 8Y, 8M, 8C and 8K, it is preferable to perform the compulsory toner consumption processing on each of the developing devices 8Y, 8M, 8C and 8K. Therefore, it is necessary to perform the compulsory toner consumption processing on each of the developing devices. Namely, it is necessary to form a compulsory consumption toner image of each toner in an inter-sheet area of the intermediate transfer belt 31 at the same time. In this regard, when the four toner images are overlaid, the overlaid toner images cannot be removed by the second belt cleaner 43.

In order to control the amount of toner of the four compulsory consumption toner images so as to fall in the range such that the toner images can be removed by the second belt cleaner 43, it is necessary to form two pieces of overlaid two compulsory consumption toner images (for example, overlaid Y and M toner images and overlaid C and K toner images) on an inter-sheet area of the intermediate transfer belt 31. However, when the two pieces of overlaid two compulsory consumption toner images are partially overlapped due to variation of positions of the toner images and therefore overlaid three or four toner images are formed, an excessive burden is placed on a part of the second cleaner 43, thereby causing a defective cleaning problem. Therefore, in order to prevent formation of such overlaid three or four toner images, it is preferable to form the two pieces of overlaid two compulsory consumption toner images with a space therebetween. However, when such a space as described in JP-4998245-B is formed in the second direction, the compulsory toner consumption efficiency deteriorates.

Figure 11:
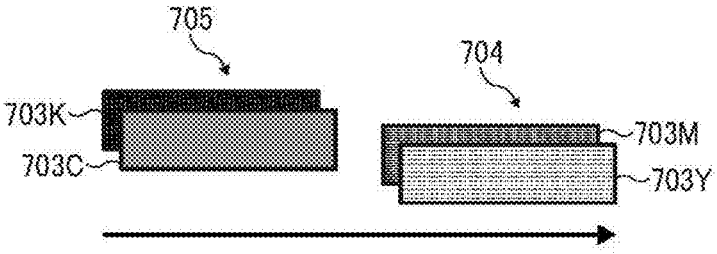
FIG. 11 is a schematic view illustrating a first-direction parallel compulsory consumption toner image.

In this printer, when demand for the compulsory toner consumption processing increases for all the developing devices 8Y, 8M, 8C and 8K (i.e., when the necessary toner compulsory consumption cumulative amount exceeds the threshold value), the main controller 260 forms such a first-direction parallel compulsory consumption toner image as illustrated in FIG. 11. As illustrated in FIG. 11, the first-direction parallel compulsory consumption toner image includes a first overlaid image portion 704 in which a compulsory consumption Y toner image 703Y and a compulsory consumption M toner image 703M are overlaid, and a second overlaid image portion 705 in which a compulsory consumption C toner image 703C and a compulsory consumption K toner image 703K are overlaid, wherein the first overlaid image portion 704 and the second overlaid image portion 705 are arranged side by side in the first direction (i.e., main scanning direction, axis direction of the photoconductor, or width direction of the intermediate transfer belt) with a predetermined space therebetween. This first-direction parallel compulsory consumption toner image can be rephrased as a main scanning direction parallel compulsory consumption toner image. Since there is a predetermined space between the first and second overlaid image portions 704 and 705, occurrence of the problem in that the first and second overlaid image portions are overlapped can be prevented.

This printer is similar to the image forming apparatus described in JP-4998245-B in that a space is formed between first and second overlaid image portions, but the large difference therebetween is that the direction along which the first and second overlaid image portions are arranged is different. Specifically, in the image forming apparatus described in JP-4998245-B, overlaid Y and C toner images and overlaid M and K toner images are arranged side by side in the sub-scanning direction (i.e., belt moving direction). It seems enough for the space to be about 5 mm. However, when there is a space of 5 mm between the two pieces of overlaid toner images in the image forming apparatus described in JP-4998245-B, the amount of toners consumed in the compulsory toner consumption processing considerably decreases. The reason therefor is the following. Specifically, in general the effective image forming area is relatively large in length in the first direction (main scanning direction) of the intermediate transfer belt 31. Since general marketed image forming apparatuses (small image forming apparatuses) can produce an A-4 size print at the minimum, the length of the effective image forming area is at least 210 mm in the first direction (main scanning direction). Since popular image forming apparatus of recent years can produce an A-3 size print, the length of the effective image forming area is about 300 mm in the first direction. Therefore, when the space is 5 mm in the image forming apparatus described in JP-4998245-B, effective image forming areas of 1050 $mm^2$ (in small image forming apparatuses) or 1500 $mm^2$ (in popular image forming apparatuses) are not used, and therefore the amount of toners consumed in the compulsory toner consumption processing considerably decreases.

As mentioned above, the printer of this disclosure forms the first-direction parallel compulsory consumption toner image (i.e., a compulsory consumption combined toner image) in which the first overlaid image portion 704 and the second overlaid image portion 705 are arranged side by side in the first direction. In this regard, in order to prevent overlapping of the first and second image portions 704 and 705, the first and second image portions are arranged in the first direction with a space of 5 mm therebetween. The length of the first and second overlaid image portions 704 and 705 in the second direction (i.e., sub-scanning direction) is not so large. In general, the length of an inter-sheet area of the intermediate transfer belt 31 in the second direction is tens of millimeters, and therefore the length of the first and second overlaid image portions 704 and 705 is about tens of millimeters. In this regard, in order to prevent occurrence of a problem in that part of the first and second overlaid image portions is formed in a sheet area due to variation in position, it is necessary to leave a space, and therefore the length of the first and second overlaid image portions 704 and 705 is about from 20 mm to 30 mm. Therefore, the area of the white area of the intermediate transfer belt 31 (i.e., the area of a space between the first and second overlaid image portions 704 and 705) is about 150 $mm^2$ (i.e., 5 mm×30 mm), which is much smaller than that (1050 or 1500 $mm^2$) in the above-mentioned image forming apparatus in which the first and second overlaid image portions are arranged side by side in the second direction, thereby making it possible to prevent occurrence of a problem in that the amount of toner consumed in the compulsory toner consumption processing decreases (i.e., a problem in that the compulsory toner consumption efficiency deteriorates) because the area of unused portion of the inter-sheet area increases.

Figure 12:
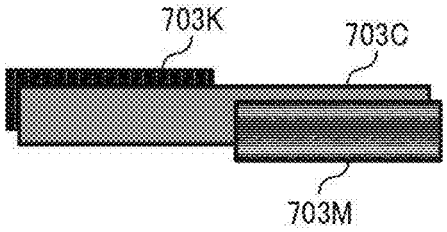
FIG. 12 is a schematic view illustrating an anomalous parallel compulsory consumption toner image.

When the demand for the compulsory toner consumption processing increases for three color toners among four color toners, the main controller 260 forms such an anomalous parallel compulsory consumption toner image as illustrated in FIG. 12 as a compulsory consumption combined toner image. In this anomalous parallel compulsory consumption toner image, two toner images (toner images 703M and 703K in FIG. 12) of the three compulsory consumption toner images (toner images 703M, 703C and 703K in FIG. 12) are formed side by side in the first direction with a space therebetween, and the other compulsory toner image (toner image 703C in FIG. 12) is overlaid on the two toner images 703M and 703K. Among the three compulsory consumption toner images, the area of the toner image 703C is the largest. In this regard, it is preferable to form the largest compulsory consumption toner image using a toner which has the largest necessary toner compulsory consumption cumulative amount. In the anomalous parallel compulsory consumption toner image, an overlaid image portion of the toner image 703M and a portion of the toner image 703C, and another overlaid image portion of the toner image 703K and another portion of the toner image 703C are arranged side by side with a space therebetween in the first direction. In this regard, a central portion of the toner image 703C is located between the two overlaid image portions, but the central portion is considered to be a space in the disclosure because the central portion consists of a single-layer toner image and is not an overlaid image portion.

Hereinafter, the compulsory consumption toner image having a small length in the first direction (such as the toner images 703Y, 703M, 703C and 703K illustrated in FIG. 11, and the toner images 703 M and 703K in FIG. 12) is referred to as a short compulsory consumption toner image, and the compulsory consumption toner image having a large length in the first direction (such as the toner image 703C in FIG. 12) is referred to as a long compulsory consumption toner image.

When the demand for the compulsory toner consumption processing increases for two color toners among four color toners, compulsory consumption toner images of the two color toners are formed in the inter-sheet area of the intermediate transfer belt 31. In this regard, such a long compulsory consumption toner image as illustrated in FIG. 10 in which solid images of the two color toners are overlaid can be formed because the compulsory consumption toner image can be removed by the second belt cleaner 43, which has a maximum cleaning ability to remove toner of an image having an image area ratio of 200%. Therefore, when the demand for the compulsory toner consumption processing increases for two color toners among four color toners, the main controller 260 forms a long compulsory consumption toner image including overlaid two color toner images, each of which has a dot area ratio of 100%, in the inter-sheet area of the intermediate transfer belt 31.

When the demand for the compulsory toner consumption processing increases only for one color toner among four color toners, the main controller 260 forms a compulsory consumption solid toner image of the color toner having a dot area ratio of 100% in the inter-sheet area. When the demand for the compulsory toner consumption processing does not increase, no compulsory consumption toner image is formed, i.e., the compulsory toner consumption processing is not performed.

In FIG. 1, the printer is illustrated from the front side thereof. Namely, in FIG. 1, the first direction (i.e., main scanning direction) is a direction perpendicular to the surface of paper on which FIG. 1 is illustrated, and the second direction (sub-scanning direction) is the direction along the surface of paper on which FIG. 1 is illustrated, i.e., a direction of from left to right which is perpendicular to the first direction.

In FIG. 11, the first direction (main scanning direction) is indicated by an arrow, wherein the right side along the first direction is the rear side of the printer, and the left side is the front side of the printer. In the first-direction parallel compulsory consumption toner image illustrated in FIG. 11, the first overlaid image portion in which the toner images 703Y and 703M are overlaid is formed at the rear side of the intermediate transfer belt 31 relative to the first direction, and the second overlaid image portion in which the toner images 703C and 703K are overlaid is formed at the front side of the intermediate transfer belt. When such a first-direction parallel compulsory consumption toner image is formed, the Y toner image 703Y and the M toner image 703M are formed only on the rear side of the photoconductors 2Y and 2M, respectively, relative to the first direction, and the C toner image 703C and the K toner image 703K are formed only on the front side of the photoconductors 2C and 2K, respectively, relative to the first direction. When such a first-direction parallel compulsory consumption toner image is repeatedly formed over a long period of time, Y and M toners of the compulsory consumption toner images remain only on the rear sides of the photoconductor 2Y and 2M, respectively, after the primary transfer operation. In this case, the residual Y and M toners contact only with the rear sides of cleaning blades (such as the cleaning blade 5K illustrated in FIG. 2) of the drum cleaners 3, thereby easily causing a blade turning problem in that a front portion of the cleaning blade is turned so as to follow the rotated photoconductor 2. Similarly, the drum cleaners 3 to clean the photoconductors 2C and 2K tend to easily cause a blade turning problem in that a rear side of the drum cleaner is turned so as to follow the rotated photoconductor 2.

Therefore, in order to prevent occurrence of the blade turning problem, the main controller 260 performs a processing of changing the positions of the first overlaid image portion and the second overlaid image portion relative to the first direction in the compulsory toner consumption processing using the first-direction parallel compulsory consumption toner image. In addition, in the compulsory toner consumption processing using the anomalous parallel compulsory consumption toner image, the main controller 260 performs a processing of changing the positions of the short compulsory consumption toner images relative to the first direction. The controller performs the position changing processing after a lapse of time (i.e., at intervals).

Figure 13:
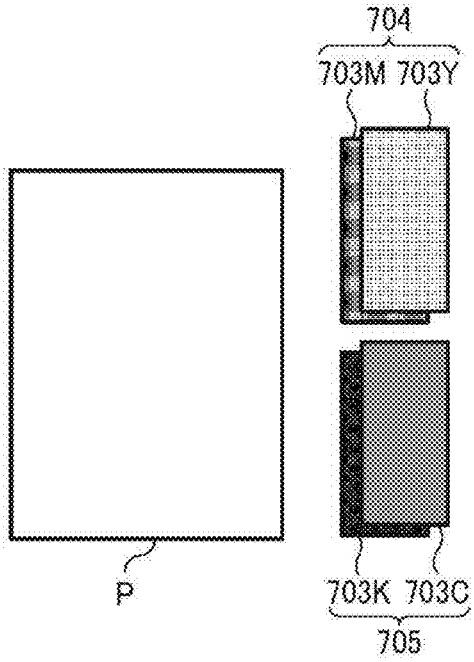
FIG. 13 is a schematic view illustrating the positions of four toner images of a compulsory consumption toner image when the main scanning direction layout flag is set to 0.

The position changing processing will be described in detail. Specifically, the main controller 260 switches a main scanning direction layout flag between 0 and 1. As illustrated in FIG. 13, when at least one of the following conditions is satisfied, the main scanning direction layout flag is set to 0.

(a) A short compulsory consumption Y toner image is formed on a rear side relative to the first direction.
(b) A short compulsory consumption M toner image is formed on a rear side relative to the first direction.
(c) A short compulsory consumption C toner image is formed on a front side relative to the first direction.
(d) A short compulsory consumption K toner image is formed on a front side relative to the first direction.

Figure 14:
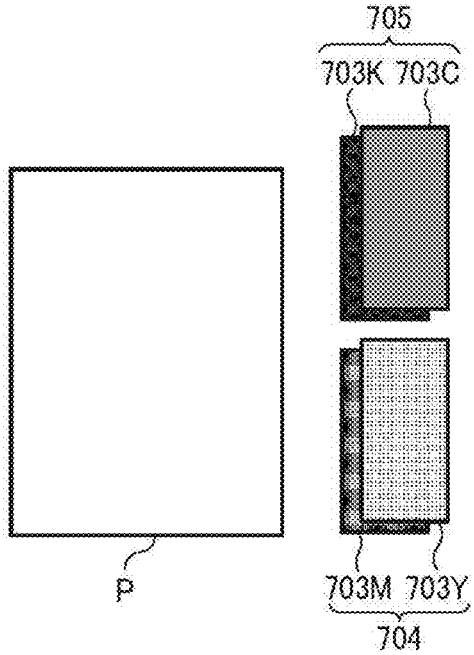
FIG. 14 is a schematic view illustrating the positions of four toner images of a compulsory consumption toner image in the main scanning direction when the main scanning direction layout flag is set to 1.

In addition, as illustrated in FIG. 14, when at least one of the following conditions is satisfied, the main controller 260 sets the main scanning direction layout flag to 1.

(e) A short compulsory consumption Y toner image is formed on a front side relative to the first direction.
(f) A short compulsory consumption M toner image is formed on a front side relative to the first direction.
(g) A short compulsory consumption C toner image is formed on a rear side relative to the first direction.
(h) A short compulsory consumption K toner image is formed on a rear side relative to the first direction.

In this printer, when at least one of short compulsory consumption Y and M toner images and at least one of short compulsory consumption C and K toner images are formed at the same time, the toner images are always arranged side by side in the first direction, wherein the position of the at least one of the Y and M toner images is opposite to the position of the at least one of the C and K toner images. Therefore, it is impossible that at least one of the conditions (a) to (d) and at least one of the conditions (e) to (h) are satisfied at the same time. Therefore, when the first-direction parallel compulsory consumption toner image or the anomalous parallel compulsory consumption toner image is formed in a compulsory toner consumption processing, the position of each of the short compulsory consumption toner images relative to the first direction is switched from the position thereof in the last compulsory toner consumption processing.

When the first-direction parallel compulsory consumption toner image or the anomalous parallel compulsory consumption toner image is formed in a compulsory toner consumption processing, the main controller 260 forms the short compulsory consumption toner images at positions in the first direction opposite to the positions in the first direction set by the main scanning direction layout flag (i.e., with a layout opposite to the layout set by the main scanning direction layout flag). Therefore, the position of a short compulsory consumption toner image in the first direction is switched between the front position and the rear position.

Therefore, in this printer, when the first-direction parallel compulsory consumption toner image is formed in this compulsory toner consumption processing, the main scanning direction layout flag setting processing in the compulsory toner consumption processing is the following. Specifically, regardless of whether the first-direction parallel compulsory consumption toner image or the anomalous parallel compulsory consumption toner image is formed in the next compulsory toner consumption processing, the main scanning direction layout flag setting processing is to switch the position of each short compulsory consumption toner image in the first direction so that the position of the toner image in the next compulsory toner consumption processing is opposite to the position in this compulsory toner consumption processing.

In addition, in this printer, when the anomalous parallel compulsory consumption toner image is formed in this compulsory toner consumption processing, the main scanning direction layout flag setting processing in the compulsory toner consumption processing is the following. Specifically, regardless of whether the first-direction parallel compulsory consumption toner image or the anomalous parallel compulsory consumption toner image is formed in the next compulsory toner consumption processing, the main scanning direction layout flag setting processing is to switch the position of each short compulsory consumption toner image in the first direction so that the position of the toner image in the next compulsory toner consumption processing is opposite to the position in this compulsory toner consumption processing.

Figure 15:
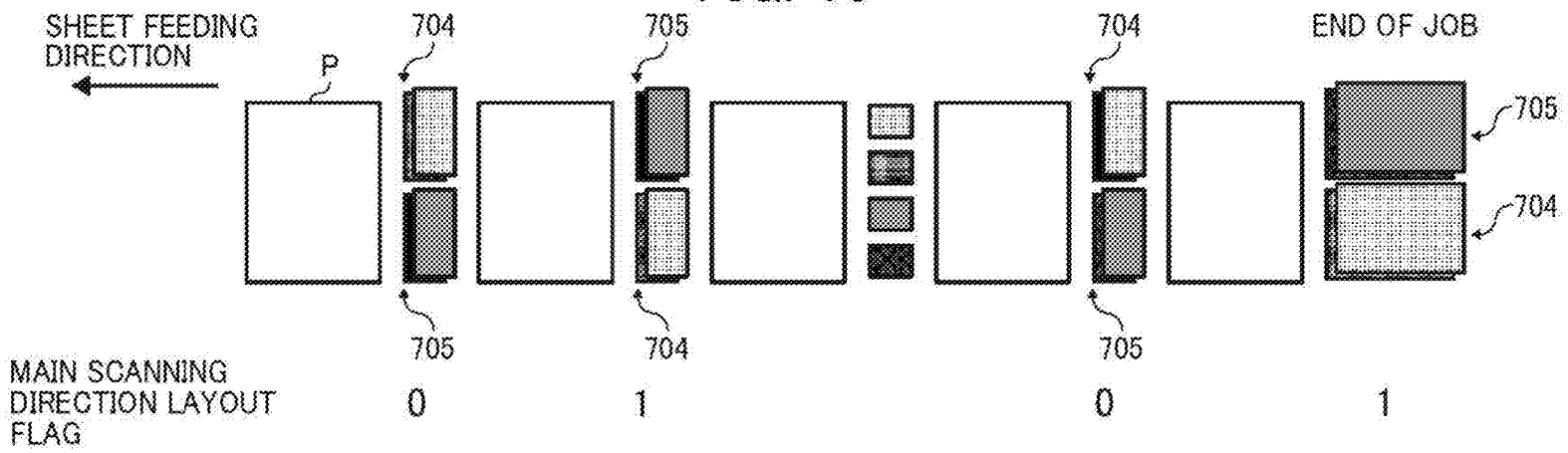
FIG. 15 is a schematic view illustrating compulsory consumption toner images to be formed in inter-sheet areas at a final stage of a continuous printing job when increased demand for a compulsory toner consumption processing for Y, M, C and K toners is maintained.

FIG. 15 is a schematic view illustrating compulsory consumption toner images to be formed in inter-sheet areas at a final stage of a continuous print job when increase of demand for a compulsory toner consumption processing for each of the Y, M, C and K toners is maintained. In this example, after one print is formed, demand for the compulsory toner consumption processing for each of the Y, M, C and K toners increases, and therefore the following first-direction parallel compulsory consumption toner image is formed, as a compulsory consumption combined toner image, in the next inter-sheet area of the intermediate transfer belt 31. Specifically, the first-direction parallel compulsory consumption toner image includes the first overlaid image portion 704 formed at the rear side relative to the first direction and the second overlaid image portion 705 formed at the front side. After this first-direction parallel compulsory consumption toner image is formed, the main scanning direction layout flag is switched from 1 to 0. When one print is formed thereafter, increase of demand for the compulsory toner consumption processing for each of the Y, M, C and K toners is still maintained, and therefore the first-direction parallel compulsory consumption toner image is formed in the next inter-sheet area of the intermediate transfer belt 31. In this regard, since the main scanning direction layout flag is set to 0, the short compulsory consumption toner images are formed with a layout opposite to the layout set by the main scanning direction layout flag. Namely, the first overlaid image portion 704 is formed at the front side relative to the first direction and the second overlaid image portion 705 is formed at the rear side.

After this first-direction parallel compulsory consumption toner image is formed, the main scanning direction layout flag is switched from 0 to 1. When one print is formed thereafter, increase of demand for the compulsory toner consumption processing for each of the Y, M, C and K toners is still maintained, and therefore it is desired to form the first-direction parallel compulsory consumption toner image in the next inter-sheet area of the intermediate transfer belt 31 as a compulsory consumption combined toner image. However, it is necessary for the printer to form the test toner images in the next inter-sheet area for the toner density target value correction processing. Since the toner density target value correction processing has priority over the compulsory toner consumption processing, the Y, M, C and K test toner images are formed in the next inter-sheet area. Since the short compulsory consumption toner images are not formed at this time, the main scanning direction layout flag is maintained at 1.

After the toner density target value correction processing is performed and then one print is formed, increase of demand for the compulsory toner consumption processing for each of the Y, M, C and K toners is still maintained, and therefore the first-direction parallel compulsory consumption toner image is formed in the next inter-sheet area. In this regard, since the main scanning direction layout flag is set to 1, the short compulsory consumption toner images are formed at positions in the first direction opposite to the positions in the first direction set by the main scanning direction layout flag (i.e., with a layout opposite to the layout (1) set by the layout flag). Namely, the first overlaid image portion 704 is formed at the rear side relative to the first direction and the second overlaid image portion 705 is formed at the front side. After this first-direction parallel compulsory consumption toner image is formed, the main scanning direction layout flag is switched from 1 to 0.

When one print is formed thereafter, increase of demand for the compulsory toner consumption processing for each of the Y, M, C and K toners is still maintained. Since the print is the final print, the area after the sheet area for the final print is not an inter-sheet area, and is a non-image area. Therefore, the first-direction parallel compulsory consumption toner image having the four short compulsory consumption toner images, each of which has a length in the second direction such that the demand for the compulsory toner consumption processing can be fully satisfied (i.e., the demand disappears) thereby, is formed in the non-image area as a compulsory consumption combined toner image, and then the continuous printing operation is ended (i.e., the job is ended). In this regard, the short compulsory consumption toner images are formed at positions in the first direction opposite to the positions in the first direction set by the main scanning direction layout flag. Namely, the first overlaid image portion 704 is formed at the front side relative to the first direction and the second overlaid image portion 705 is formed at the rear side of the intermediate transfer belt 31.

Since the positions of the first and second overlaid image portions 704 and 705 are switched, the positions of the photoconductors 2Y, 2M, 2C and 2K on which the short compulsory consumption toner images are formed are switched from the front side to the rear side, and therefore occurrence of the blade turning problem in that the cleaning blade is turned so as to follow the rotated photoconductor can be prevented.

Figure 16:
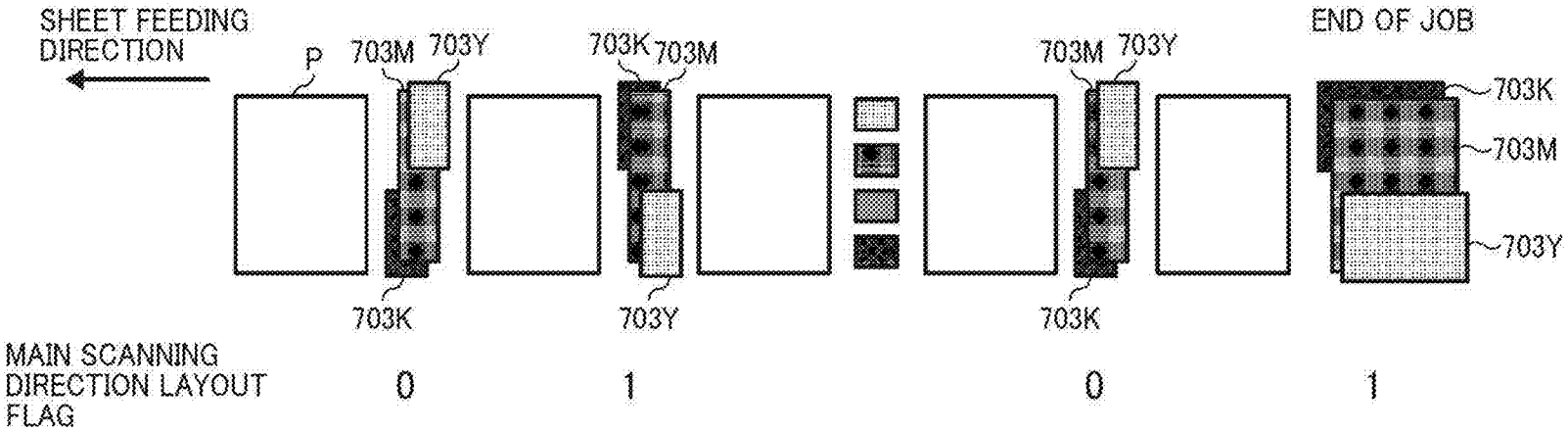
FIG. 16 is a schematic view illustrating compulsory consumption toner images to be formed in inter-sheet areas at a final stage of a continuous printing job when increased demand for a compulsory toner consumption processing for Y, M and K toners is maintained.

FIG. 16 is a schematic view illustrating compulsory consumption toner images (i.e., a compulsory consumption combined toner image) to be formed in inter-sheet areas at a final stage of a continuous print job when increase of demand for a compulsory toner consumption processing for each of the Y, M and K toners is maintained. In this example, after one print is formed, demand for the compulsory toner consumption processing for each of the Y, M and K toners increase, and therefore the following anomalous parallel compulsory consumption toner image (i.e., a compulsory consumption combined toner image) is formed in the next inter-sheet area of the intermediate transfer belt 31. Specifically, the anomalous parallel compulsory consumption toner image includes a short compulsory consumption Y toner image 703Y formed at the rear side relative to the first direction, a short compulsory consumption K toner image 703K formed at the front side, and a long compulsory consumption M toner image 703M which is overlaid on each of the Y and K toner images. The reason why the compulsory consumption M toner image is long is that the M toner has the largest necessary toner compulsory consumption cumulative amount among the three toners.

After the anomalous parallel compulsory consumption toner image is formed, the main controller 260 sets the main scanning direction layout flag to 0. After one print is formed thereafter, increase of demand for the compulsory toner consumption processing for each of the Y, M and K toners is still maintained, and therefore the anomalous parallel compulsory consumption toner image is formed in the next inter-sheet area. In this regard, since the main scanning direction layout flag is set to 0, the short compulsory consumption Y and K toner images 703Y and 703K are formed at positions in the first direction opposite to the positions in the first direction set by the main scanning direction layout flag (i.e., with a layout opposite to the layout (0) set by the main scanning direction layout flag). Namely, the short compulsory consumption Y toner image 703Y is formed at the front side relative to the first direction and the short compulsory K toner image 703K is formed at the rear side of the intermediate transfer belt 31.

After the anomalous parallel compulsory consumption toner image is formed, the main scanning direction layout flag is switched from 0 to 1. When one print is formed thereafter, increase of demand for the compulsory toner consumption processing for each of the Y, M and K toners is still maintained, and therefore it is desired to form the anomalous parallel compulsory consumption toner image. However, it is necessary for the printer to form test toner images in the next inter-sheet area for the toner density target value correction processing. Since the toner density target value correction processing has priority over the compulsory toner consumption processing, the main controller 260 forms the Y, M, C and K test toner images in the next inter-sheet area. Since the short compulsory consumption toner images are not formed at this time, the main scanning direction layout flag is maintained at 1.

After the toner density target value correction processing is performed and then one print is formed, increase of demand for the compulsory toner consumption processing for each of the Y, M and K toners is still maintained, and therefore the anomalous parallel compulsory consumption toner image is formed in the next inter-sheet area. In this regard, since the main scanning direction layout flag is set to 1, the short compulsory consumption toner images are formed at positions in the first direction opposite to the positions in the first direction set by the main scanning direction layout flag (i.e., with a layout opposite to the layout (1) set by the main scanning direction layout flag). Namely, the short compulsory consumption Y toner image 703Y is formed at the rear side relative to the first direction, the short compulsory consumption K toner image 703K is formed at the front side, and the long compulsory consumption M toner image 703M is formed so as to be overlaid on each of the toner images 703Y and 703K. After this anomalous parallel compulsory consumption toner image is formed, the main scanning direction layout flag is switched from 1 to 0.

When one print is formed thereafter, increase of demand for the compulsory toner consumption processing for each of the Y, M and K toners is still maintained. Since the print is the final print, the area after the sheet area for the final print is not an inter-sheet area, and is a non-image area. Therefore, the anomalous parallel compulsory consumption toner image having the three compulsory consumption toner images, each of which has a length in the second direction such that the demand for the compulsory toner consumption processing can be fully satisfied (i.e., the demand disappears) thereby, is formed in the non-image area, and then the continuous printing operation is ended (i.e., the job is ended). In this regard, the short compulsory consumption toner images are formed at positions in the first direction opposite to the positions in the first direction set by the main scanning direction layout flag (i.e., with a layout opposite to the layout (0) set by the main scanning direction layout flag). Namely, the short compulsory consumption Y toner image 703Y is formed at the front side relative to the first direction and the short compulsory K toner image 703K is formed at the rear side.

Since the positions of the short compulsory consumption Y and K toner images 703Y and 703K are switched, the positions of the photoconductors 2Y and 2K on which the short compulsory consumption toner images are formed are switched from the front side to the rear side, and therefore occurrence of the blade turning problem in that the cleaning blade is turned so as to follow the rotated photoconductor can be prevented.

Figure 17:
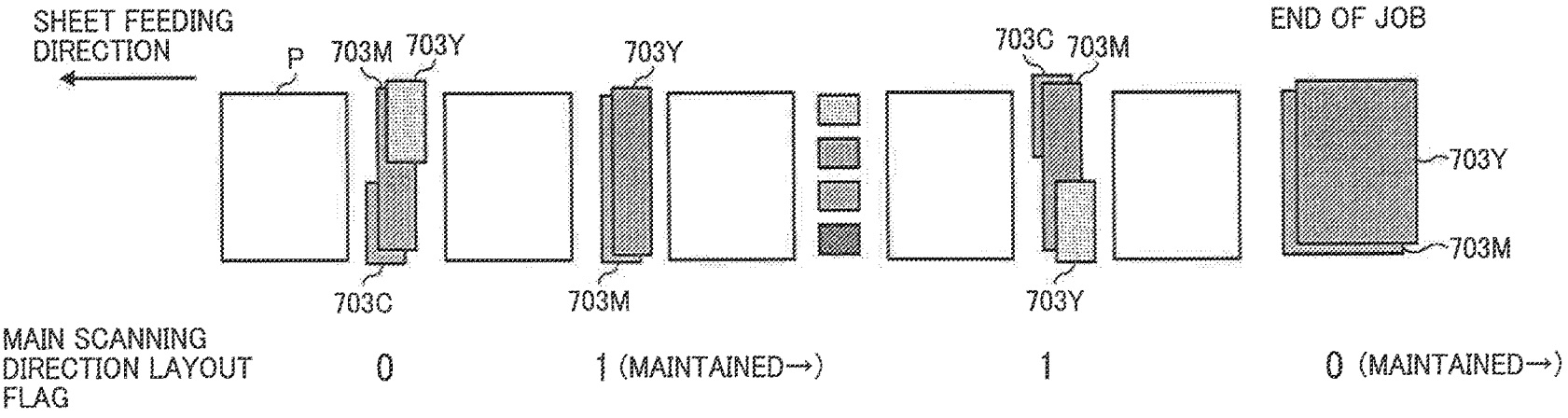
FIG. 17 is a schematic view illustrating compulsory consumption toner images to be formed in inter-sheet areas at a final stage of a continuous printing job when a case in which demand for a compulsory toner consumption processing for three toners increases and a case in which demand for a compulsory toner consumption processing for two toners increases are mixed.

FIG. 17 is a schematic view illustrating compulsory consumption toner images (i.e., a compulsory consumption combined toner image) to be formed in inter-sheet areas at a final stage of a continuous print job when a case in which demand for a compulsory toner consumption processing for three toners increases and a case in which demand for a compulsory toner consumption processing for two toners increases are mixed. In this example, after one print is formed, demand for the compulsory toner consumption processing for each of the Y, M and C toners increase, and therefore the following anomalous parallel compulsory consumption toner image is formed in the next inter-sheet area. Specifically, the anomalous parallel compulsory consumption toner image includes a short compulsory consumption Y toner image 703Y formed at the rear side relative to the first direction, a short compulsory consumption C toner image 703C formed at the front side, and a long compulsory consumption M toner image 703M which is overlaid on each of the Y and C toner images. The reason why the compulsory consumption M toner image is long is that the M toner has the largest necessary toner compulsory consumption cumulative amount among the three toners.

After the anomalous parallel compulsory consumption toner image is formed, the main controller 260 sets the main scanning direction layout flag to 0. After one print is formed, increase of demand for the compulsory toner consumption processing for each of the Y and M toners is still maintained, and therefore long compulsory consumption Y and M toner images 703Y and 703M are formed in the next inter-sheet area while overlaid. In this regard, since short compulsory consumption Y and M toner images are not formed, the main scanning direction layout flag is maintained at 1.

After the long compulsory consumption toner images 703Y and 703M are formed, and then one print is formed, demand for the compulsory toner consumption processing for each of the Y, M and C toners increases, and therefore it is desired to form the anomalous parallel compulsory consumption toner image in the next inter-sheet area. However, it is necessary for the printer to form the test toner images in the next inter-sheet area for the toner density target value correction processing. Since the toner density target value correction processing has priority over the compulsory toner consumption processing, the main controller 260 forms the Y, M, C and K test toner images in the next inter-sheet area. Since the short compulsory consumption toner images are not formed at this time, the main scanning direction layout flag is maintained at 1.

After the toner density target value correction processing is performed and then one print is formed, demand for the compulsory toner consumption processing for each of the Y, M and C toners increases, and therefore the anomalous parallel compulsory consumption toner image is formed in the next inter-sheet area. In this regard, since the main scanning direction layout flag is set to 1, the short compulsory consumption toner images are formed at positions in the first direction opposite to the positions in the first direction set by the main scanning direction layout flag. Namely, the short compulsory consumption Y toner image 703Y is formed at the front side relative to the first direction, the short compulsory consumption C toner image 703C is formed at the rear side, and the long compulsory consumption M toner image is formed so as to be overlaid on each of the Y and C toner images. After this anomalous parallel compulsory consumption toner image is formed, the main scanning direction layout flag is switched from 1 to 0.

When one print is formed thereafter, demand for the compulsory toner consumption processing for each of the Y and M toners increase. Since the print is the final print, the area after the sheet area for the final print is not an inter-sheet area, and is a non-image area. Therefore, the long compulsory consumption toner images, each of which has a length in the second direction such that the demand for the compulsory toner consumption processing can be fully satisfied (i.e., the demand disappears) thereby, is formed in the non-image area, and then the continuous printing operation is ended (i.e., the job is ended).

Thus, even in a case in which the anomalous parallel compulsory consumption toner image is not repeated and a compulsory consumption toner image using one or two color toners is formed between two anomalous parallel compulsory consumption toner images, the positions of the short compulsory consumption toner images can be switched by maintaining (i.e., without changing) the main scanning direction layout flag when the compulsory consumption toner image is formed using one or two color toners.

Figure 18:
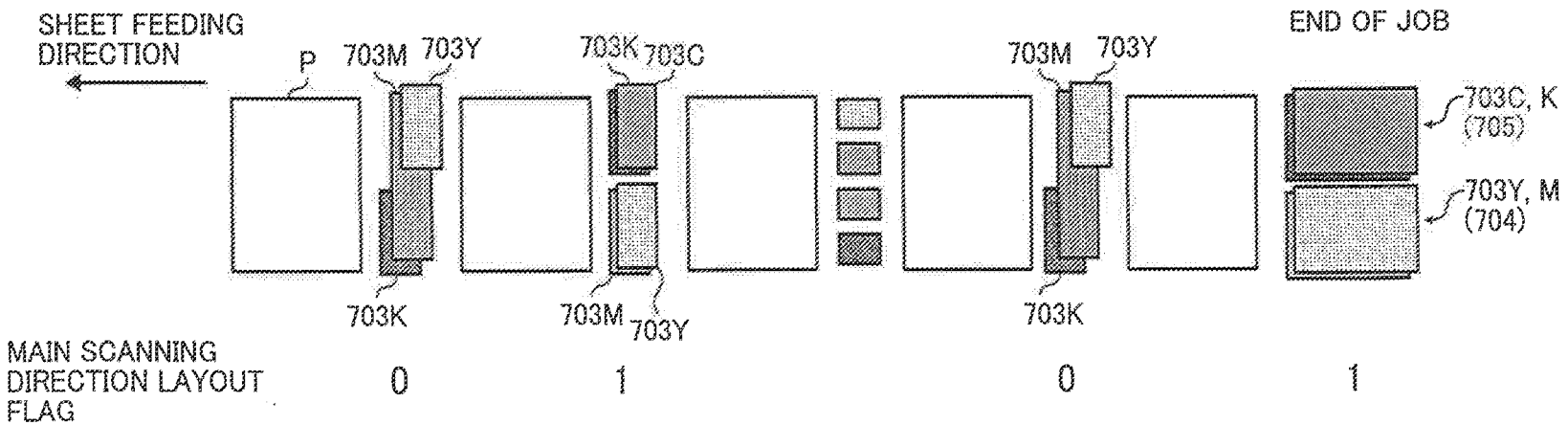
FIG. 18 is a schematic view illustrating compulsory consumption toner images to be formed in inter-sheet areas at a final stage of a continuous printing job when a case in which demand for a compulsory toner consumption processing for three toners increases and a case in which demand for a compulsory toner consumption processing for four toners increases are mixed.

FIG. 18 is a schematic view illustrating compulsory consumption toner images (i.e., a compulsory consumption combined toner image) to be formed in inter-sheet areas at a final stage of a continuous print job when a case in which demand for a compulsory toner consumption processing for three toners increases and a case in which demand for a compulsory toner consumption processing for four toners increases are mixed. In this example, after one print is formed, demand for the compulsory toner consumption processing for each of the Y, M and K toners increase, and therefore the following anomalous parallel compulsory consumption toner image is formed in the next inter-sheet area of the intermediate transfer belt 31. Specifically, the anomalous parallel compulsory consumption toner image includes a short compulsory consumption Y toner image 703Y formed at the rear side relative to the first direction, a short compulsory consumption K toner image 703K formed at the front side, and a long compulsory consumption M toner image 703M which is overlaid on each of the Y and K toner images.

After the anomalous parallel compulsory consumption toner image is formed, the main controller 260 sets the main scanning direction layout flag to 0. After one print is formed thereafter, demand for the compulsory toner consumption processing for each of the Y, M, C and K toners increases, and therefore the first-direction parallel compulsory consumption toner image is formed in the next inter-sheet area. In this regard, since the main scanning direction layout flag is 0, the short compulsory consumption toner images are formed at positions in the first direction opposite to the positions in the first direction set by the main scanning direction layout flag (i.e., with a layout opposite to the layout (0) set by the main scanning direction layout flag). Namely, the overlaid short compulsory consumption toner images 703C and 703K are formed at the rear side relative to the first direction, and the overlaid short compulsory consumption toner images 703Y and 703M are formed at the front side of the intermediate transfer belt 31.

After the first-direction parallel compulsory consumption toner image is formed, the main scanning direction layout flag is switched from 0 to 1. After one print is formed thereafter, demand for the compulsory toner consumption processing for each of the Y, M and K toners increases, and therefore it is desired to form the anomalous parallel compulsory consumption toner image in the next inter-sheet area. However, it is necessary for the printer to form the test toner images in the next inter-sheet area for the toner density target value correction processing. Since the toner density target value correction processing has priority over the compulsory toner consumption processing, the main controller 260 forms the Y, M, C and K test toner images in the next inter-sheet area. Since the short compulsory consumption toner images are not formed at this time, the main scanning direction layout flag is maintained at 1.

After the toner density target value correction processing is performed and then one print is formed, increase of demand for the compulsory toner consumption processing for each of the Y, M and K toners is maintained, and therefore the anomalous parallel compulsory consumption toner image is formed in the next inter-sheet area. In this regard, since the main scanning direction layout flag is set to 1, the short compulsory consumption toner images are formed at positions in the first direction opposite to the positions in the first direction set by the main scanning direction layout flag. Namely, the short compulsory consumption Y toner image 703Y is formed at the rear side relative to the first direction, the short compulsory consumption K toner image 703K is formed at the front side, and the long compulsory consumption M toner image is formed so as to be overlaid on each of the Y and K toner images. After this anomalous parallel compulsory consumption toner image is formed, the main scanning direction layout flag is switched from 1 to 0.

When one print is formed thereafter, demand for the compulsory toner consumption processing for each of the Y, M, C and K toners increases. Since the print is the final print, the area after the sheet area for the final print is not an inter-sheet area, and is a non-image area. Therefore, the first-direction compulsory consumption toner image including overlaid short compulsory consumption C and K toner images 703C and 703K and overlaid short compulsory consumption Y and M toner images 703Y and 703M, each of which has a length in the second direction such that the demand for the compulsory toner consumption processing can be fully satisfied (i.e., the demand disappears) thereby, is formed in the non-image area, and then the continuous printing operation is ended (i.e., the job is ended).

Thus, even in a case in which the first-direction parallel compulsory consumption toner image and the anomalous parallel compulsory consumption toner image are formed at different inter-sheet areas, the positions of the short compulsory consumption toner images can be switched by changing the main scanning direction layout flag after the short compulsory consumption toner images are formed.

As mentioned above, it is preferable to change the positions of the short compulsory consumption toner images by changing the main scanning direction layout flag, but it is possible to change the positions of the short compulsory consumption toner images with a lapse of time (i.e., at intervals).

Figures 19, 19A, 19B:
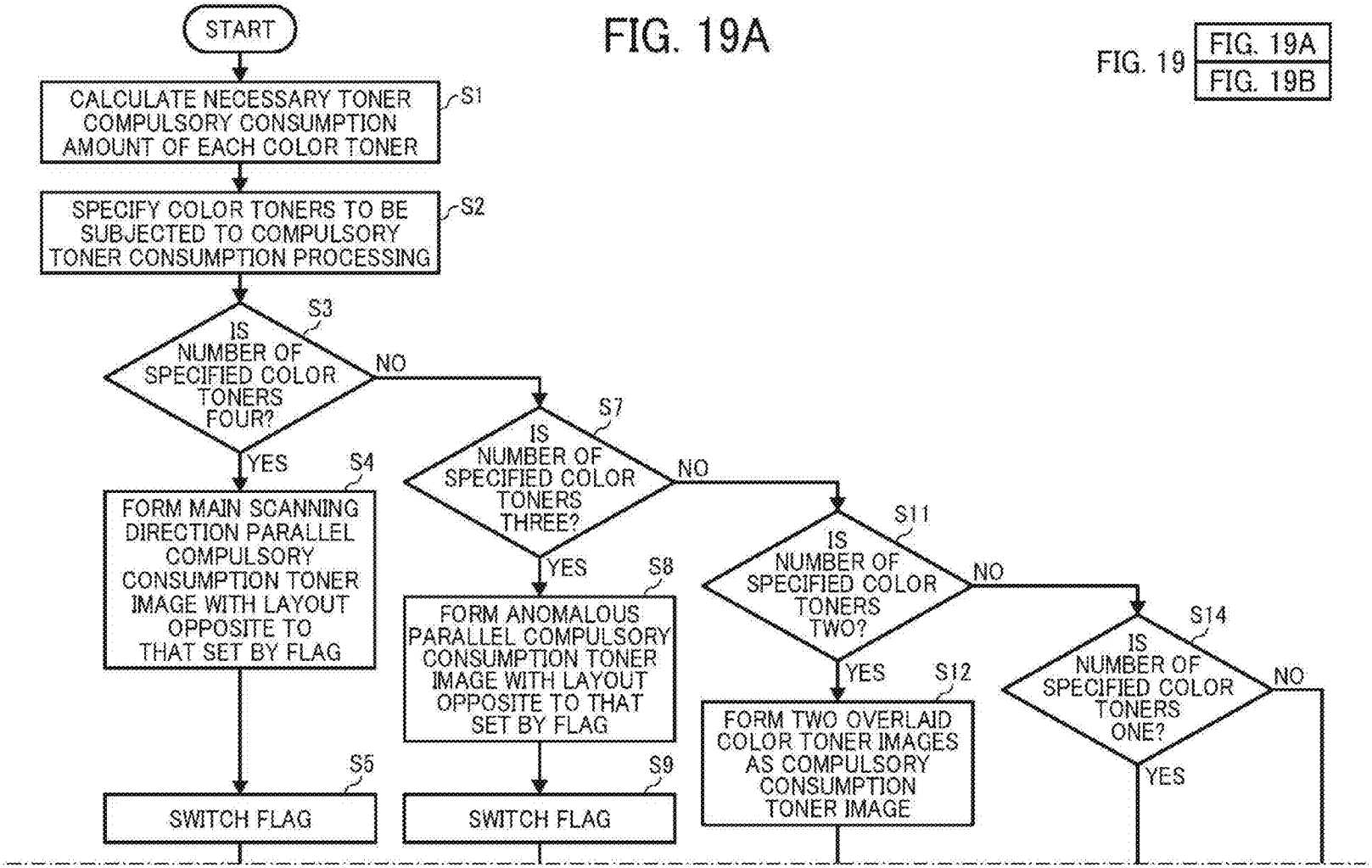
FIGS. 19A and 19B are a flowchart illustrating a compulsory toner consumption processing performed by a main controller of the printer.
Figure 19B:
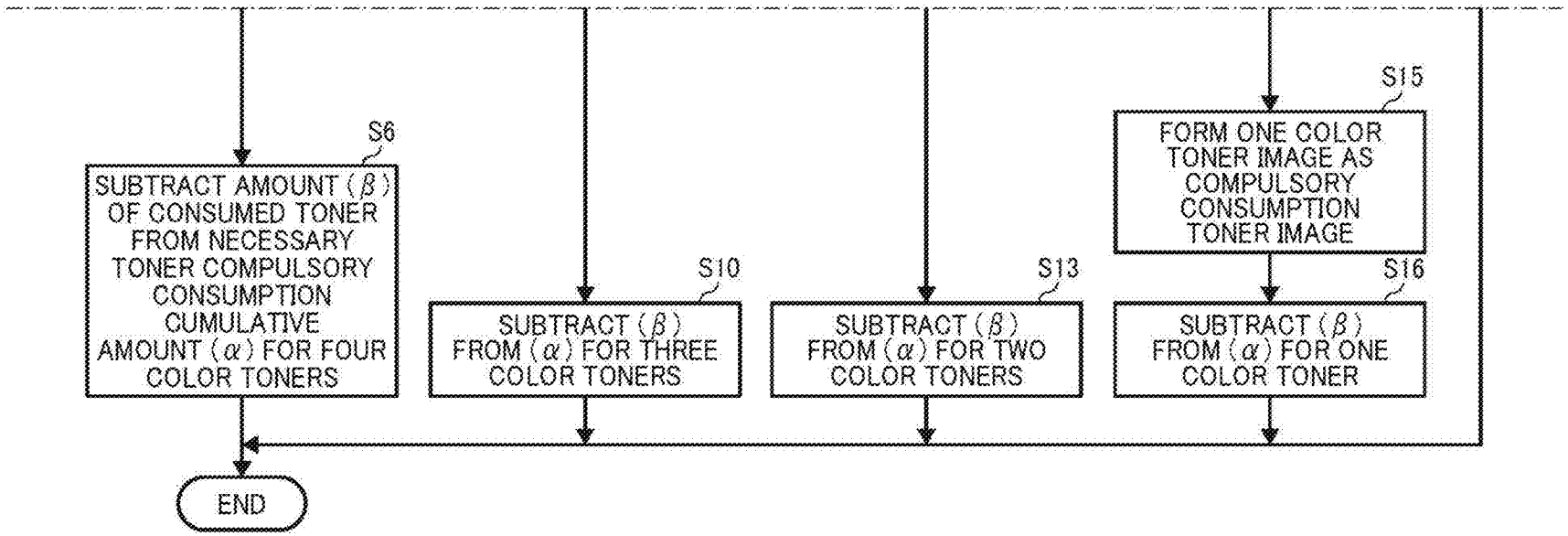

FIG. 19 is a flowchart illustrating a compulsory toner consumption processing performed by the main controller 260 of the printer. When the main controller 260 starts the compulsory toner consumption processing, the main controller calculates the necessary toner compulsory consumption amount of each of Y, M, C and K color toners based on the developed area of the last one print in step S1. The main controller 260 adds the calculated necessary toner compulsory consumption amount to a necessary toner compulsory consumption cumulative amount for each color toner to update the necessary toner compulsory consumption cumulative amount $\alpha$ (i.e., $\alpha_Y$, $\alpha_M$, $\alpha_C$, and $\alpha_K$) of each color toner, and compares the updated necessary toner compulsory consumption cumulative amount with a predetermined threshold value to specify the color toner or toners to be subjected to the compulsory toner consumption processing (step S2). Next, the main controller 260 judges whether the number of the specified color toners to be subjected to the compulsory toner consumption processing is four in step S3. When the number is four (i.e., YES in step S3), the main controller 260 forms the first-direction parallel compulsory consumption toner image in an inter-sheet area of the intermediate transfer belt 31. Namely, the main controller 260 forms the short compulsory consumption toner images at positions in the first direction opposite to the positions in the first direction set by the main scanning direction layout flag (i.e., with a layout opposite to the layout set by the layout flag) in step S4. After this compulsory toner consumption processing, the main controller 260 switches the main scanning direction layout flag in step S5, and subtracts the amount ($\beta$) of consumed toner from the necessary toner compulsory consumption cumulative amount $\alpha$ for each of the four color toners to update the necessary toner compulsory consumption cumulative amount of each toner in step S6. Thereafter, this processing flow is ended.

When it is judged in step S3 that the number of the specified color toners to be subjected to the compulsory toner consumption processing is not four (i.e., NO in step S3), it is judged whether the number of the specified color toners to be subjected to the compulsory toner consumption processing is three in step S7. When the number of the specified color toners to be subjected to the compulsory toner consumption processing is three in step S7 (i.e., YES in step S7), an anomalous parallel compulsory consumption toner image including two short compulsory consumption toner images and one long compulsory consumption toner image is formed in an inter-sheet area of the intermediate transfer belt 31 in step S8, wherein the layout of the two short compulsory consumption toner images is opposite to the layout set by the main scanning direction layout flag. After this compulsory toner consumption processing, the main controller 260 switches the main scanning direction layout flag in step S9, and subtracts the amount ($\beta$) of consumed toner from the necessary toner compulsory consumption cumulative amount $\alpha$ for each of the three color toners to update the necessary toner compulsory consumption cumulative amount of each toner in step S10. Thereafter, this processing flow is ended.

When it is judged in step S7 that the number of the specified color toners to be subjected to the compulsory toner consumption processing is not three (i.e., NO in step S7), it is judged whether the number of the specified color toners to be subjected to the compulsory toner consumption processing is two in step S11. When the number of the specified color toners to be subjected to the compulsory toner consumption processing is two in step S11 (i.e., YES in step S11), a compulsory consumption toner image including two overlaid long compulsory consumption toner images is formed in an inter-sheet area of the intermediate transfer belt 31 in step S12. After this compulsory toner consumption processing, the main controller 260 does not switch the main scanning direction layout flag, and subtracts the amount ($\beta$) of consumed toner from the necessary toner compulsory consumption cumulative amount $\alpha$ for each of the two color toners to update the necessary toner compulsory consumption cumulative amount of each toner in step S13. Thereafter, this processing flow is ended.

When it is judged in step S11 that the number of the specified color toners to be subjected to the compulsory toner consumption processing is not two (i.e., NO in step S11), it is judged whether the number of the specified color toners to be subjected to the compulsory toner consumption processing is one in step S14. When the number of the specified color toners to be subjected to the compulsory toner consumption processing is one in step S14 (i.e., YES in step S14), a compulsory consumption toner image including one long compulsory consumption toner image is formed in an inter-sheet area of the intermediate transfer belt 31 in step S15. After this compulsory toner consumption processing, the main controller 260 does not switch the main scanning direction layout flag, and subtracts the amount ($\beta$) of consumed toner from the necessary toner compulsory consumption cumulative amount $\alpha$ for the color toner to update the necessary toner compulsory consumption cumulative amount of the toner in step S16. Thereafter, this processing flow is ended.

When it is judged in step S14 that the number of the specified color toners to be subjected to the compulsory toner consumption processing is not one (i.e., NO in step S14), there is no toner to be subjected to the compulsory toner consumption processing, and therefore this processing flow is ended without performing the compulsory toner consumption processing.

Hereinbefore, cases in which the number of the compulsory consumption toner images is three or four are mainly described. However, the number of the compulsory consumption toner images is not limited thereto. For example, when the number of the compulsory consumption toner images is five, the compulsory consumption combined toner image includes a first overlaid image portion consisting of first and second toner images, and an anomalous parallel compulsory consumption toner image consisting of third, fourth and fifth toner images, which are arranged side by side in the first direction with a space therebetween. When the number of the compulsory consumption toner images is six, the compulsory consumption combined toner image includes a first overlaid image portion consisting of first and second toner images, a second overlaid image portion consisting of third and fourth toner images, and a third overlaid image portion consisting of fifth and sixth toner images, which are arranged side by side in the first direction with a space therebetween.

The above-mentioned printer is an example of the image forming apparatus of this disclosure, and this disclosure includes the following embodiments producing their specific effects.

(Embodiment A)

The image forming apparatus of Embodiment A includes an image forming device (such as the image forming units 1Y, 1M, 1C and 1K and the optical writing unit 80) to form a toner image on each of at least four image bearers (such as photoconductors 2Y, 2M, 2C and 2K), a transferring device (such as the transferring unit 30) to transfer the toner images to a movable transfer medium, and a controller (such as the main controller 260). The controller performs a compulsory toner consumption processing such that a toner image is formed on at least one of the at least four image bearers to forcibly consume the toner. When the controller performs the compulsory toner consumption processing using four image bearers and four color toners, a first toner image (first short compulsory consumption toner image) formed on a first image bearer and a second toner image (second short compulsory consumption toner image) formed on a second image bearer are transferred on the transfer medium so as to be overlaid to form a first overlaid image portion on the transfer medium, and a third toner image (third short compulsory consumption toner image) formed on a third image bearer and a fourth toner image (fourth short compulsory consumption toner image) formed on a fourth image bearer are transferred on the transfer medium so as to be overlaid to form a second overlaid image portion on the transfer medium, wherein the first and second overlaid image portions are arranged side by side with a space therebetween in a first direction perpendicular to the moving direction of the transfer medium to form a first-direction parallel compulsory consumption toner image.

In this image forming apparatus of Embodiment A, a space is formed between the first overlaid image portion and the second overlaid image portion of the first-direction parallel compulsory consumption toner image to prevent overlapping of the first and second overlaid image portions even when positions of the first and second overlaid image portions vary, i.e., to prevent formation of an excessively-overlaid image portion in which three or more toner images are overlaid, thereby making it possible to prevent occurrence of problems such that the excessively-overlaid image portion cannot be satisfactorily removed from the transfer medium by a cleaner, resulting in defective cleaning; and the cleaner used is damaged due to the excessively-overlaid image portion.

Since such a space as mentioned below is formed between the first and second overlaid image portions of the first-direction parallel compulsory consumption toner image, deterioration of the compulsory toner consumption efficiency can be prevented. Specifically, overlapping of two different image portions on the transfer medium can be prevented by forming a space therebetween, which space is slightly greater than the maximum value of the positional variation of the interval between the two different image portions regardless of whether the two different image portions are arranged side by side in the first direction or the second direction perpendicular to the first direction. Therefore, the space is not so large, and is about 5 mm in general image forming apparatuses. However, when the two image portions are arranged side by side in the second (sub-scanning) direction (for example, in the image forming apparatus described in JP-4998245-B1, the space extends in the first (main scanning) direction, thereby seriously deteriorating the compulsory toner consumption efficiency. Specifically, since general marketed image forming apparatuses can produce an A-4 size print at the minimum, the length of the effective image forming area is at least 210 mm in the first direction (main scanning direction). Since popular image forming apparatus of recent years can produce an A-3 size print, the length of the effective image forming area is about 300 mm in the first direction. Therefore, when the first and second overlaid image portions are arranged side by side in the second direction with a space therebetween, the area of the space is much greater than in a case in which the first and second overlaid image portions are arranged side by side in the first direction. Therefore, when the first and second overlaid image portions are arranged side by side in the second direction with a space therebetween, the compulsory toner consumption efficiency seriously deteriorates.

In contrast, in the image forming apparatus of Embodiment A, the first and second overlaid image portions are arranged side by side in the first direction with a space therebetween. As mentioned above, the space is not so large, and is about 5 mm. When the compulsory toner consumption processing is performed relatively frequently, for example, after every one print, the amount of toner to be consumed by the compulsory toner consumption processing is not so large, and therefore the area of the compulsory consumption toner image (such as the first and second overlaid image portions) is not so large. In addition, since the length of the effective image area in the first direction is considerably large, the length (L) of the first and second overlaid image portions in the second direction is not so large. Namely, the area of the space between the first and second overlaid image portions is 5 mm×L(mm), and therefore the area of the space is much smaller than the area of the space when the first and second overlaid image portions are arranged side by side in the second direction. Therefore, arranging the first and second overlaid image portions side by side in the first direction has a higher compulsory toner consumption efficiency than arranging the first and second overlaid image portions side by side in the second direction.

(Embodiment B)

The image forming apparatus of Embodiment B is characterized in that, in the image forming apparatus of Embodiment A, the controller performs the compulsory toner consumption processing in such a manner that the position of the first overlaid image portion relative to the first direction is changed with the position of the second overlaid image portion after a lapse of time (i.e., at intervals).

As mentioned above, the image forming apparatus of Embodiment B can produce an effect to prevent occurrence of the blade turning problem in that a front or rear portion of a drum cleaner to clean the rotated image bearer is turned so as to follow the rotated image bearer unlike in the case in which the position of the first overlaid image portion relative to the first direction is not changed with the position of the second overlaid image portion.

(Embodiment C)

The image forming apparatus of Embodiment C is characterized in that, in the image forming apparatus of Embodiment B, the controller performs the compulsory toner consumption processing in such a manner that when the controller performs the compulsory toner consumption processing using three image bearers and three color toners, the controller forms, on the transfer medium, an anomalous compulsory consumption toner image including two short compulsory consumption toner images, which are formed of two of the three toners and arranged side by side in the first direction with a space therebetween, and a long compulsory consumption toner image, which is formed of the other toner and extends in the first direction so as to be overlaid on the two short compulsory consumption toner images.

In the image forming apparatus of Embodiment C, since the area of the long compulsory consumption toner image is large, the compulsory toner consumption efficiency of the toner is relatively high compared with a case in which the other toner image is overlaid on one of the two short compulsory consumption toner images.

(Embodiment D)

The image forming apparatus of Embodiment D is characterized in that, in the image forming apparatus of Embodiment C, the controller performs the compulsory toner consumption processing in such a manner that when the first-direction parallel compulsory consumption toner image is formed in the last compulsory toner consumption processing, the positions of the short compulsory consumption toner images (the first and second overlaid image portions) on the image bearers relative to the first direction are changed in the next compulsory toner consumption processing regardless of whether a first-direction parallel compulsory consumption toner image or an anomalous parallel compulsory consumption toner image is formed in the next compulsory toner consumption processing.

In the image forming apparatus of Embodiment D, regardless of whether the first-direction parallel compulsory consumption toner image or the anomalous parallel compulsory consumption toner image is formed in the next compulsory toner consumption processing, the positions of the short compulsory consumption toner images in the next compulsory toner consumption processing are changed relative to the first direction from the positions of the short compulsory consumption toner images in this compulsory toner consumption processing. Therefore, the image forming apparatus of Embodiment D can produce an effect to prevent occurrence of the blade turning problem in that a front or rear portion of a drum cleaner to clean a rotated image bearer is turned so as to follow the rotated image bearer unlike in the case in which the positions of the short compulsory consumption toner images relative to the first direction are not changed.

(Embodiment E)

The image forming apparatus of Embodiment E is characterized in that, in the image forming apparatus of Embodiment D, the controller performs the compulsory toner consumption processing in such a manner that when the anomalous parallel compulsory consumption toner image is formed in the last compulsory toner consumption processing, the positions of the short compulsory consumption toner images on the image bearers relative to the first direction are changed in the next compulsory toner consumption processing regardless of whether a first-direction parallel compulsory consumption toner image or an anomalous parallel compulsory consumption toner image is formed in the next compulsory toner consumption processing.

The image forming apparatus of Embodiment E can produce an effect to prevent occurrence of the blade turning problem in that a front or rear portion of a drum cleaner to clean a rotated image bearer is turned so as to follow the rotated image bearer unlike in the case in which the positions of the short compulsory consumption toner images relative to the first direction are not changed.

(Embodiment F)

The image forming apparatus of Embodiment F is characterized in that, in the image forming apparatus of any one of Embodiments C to E, the controller performs the compulsory toner consumption processing in such a manner that when the anomalous parallel compulsory consumption toner image is formed, the long compulsory consumption toner image is formed of a toner having the largest necessary toner compulsory consumption cumulative amount among the three color toners.

The image forming apparatus of Embodiment E can produce an effect such that since a large amount of the toner having the largest necessary toner compulsory consumption cumulative amount is consumed in the compulsory toner consumption processing, the deteriorated toner removing efficiency (i.e., the compulsory toner consumption efficiency) can be enhanced for the toner.

(Embodiment G)

The image forming apparatus of Embodiment G is characterized in that, in the image forming apparatus of any one of Embodiments C to F, the transfer medium is an endless multi-layer transfer belt having an outermost layer made of an elastic material (such as the intermediate transfer belt 31), and the image forming apparatus further includes a nip forming member (such as the nip forming belt 41) to form a transfer nip by contacting the transfer belt, a transfer power source (such as the secondary transfer power source 39) to output a transfer bias of an AC and DC superimposition voltage to the nip forming member so that a transfer current flows at the transfer nip, a sheet feeding device (such as the sheet feeding cassette 100)) to feed a recording sheet to the transfer nip, a first cleaner (such as the first belt cleaner 37) to clean the surface of the transfer belt after the transfer belt passes the transfer nip, and a second cleaner (such as the second belt cleaner 43) to clean the surface of the nip forming member after the nip forming member passes the transfer nip, wherein the toner image to be output as a print is transferred to the recording sheet at the transfer nip and toner remaining on the transfer medium without being transferred to the recording sheet is removed therefrom by the first belt cleaner, and wherein the first-direction parallel compulsory consumption toner image and the anomalous parallel compulsory consumption toner image on the transfer belt are transferred to the nip forming member at the transfer nip and the second cleaner removes the first-direction parallel compulsory consumption toner image and the anomalous parallel compulsory consumption toner image from the nip forming member.

The image forming apparatus of Embodiment F has an advantage such that since a multi-layer transfer belt is used while an AC and DC superimposition voltage is applied as the transfer bias, occurrence of formation of uneven density images can be prevented even when rough paper such as Japan paper is used as the recording sheet. In addition, although a cleaning blade, which has a high cleanability, cannot be used as the first cleaner because a multi-layer transfer belt is used as the transfer medium, the compulsory consumption toner image can be removed from the nip forming member by the second cleaner, thereby making it possible to prevent occurrence of the toner re-adhesion problem mentioned above.

(Embodiment H)

The image forming apparatus of Embodiment H is characterized in that, in the image forming apparatus of Embodiment G, the controller performs the compulsory toner consumption processing in such a manner that when the compulsory consumption toner image is formed using two of the plural image bearers and two color toners, two long compulsory consumption toner images of the two color toners are formed on the two image bearers, and the two long compulsory consumption toner images are transferred to the transfer belt so as to be overlaid to form the compulsory consumption toner image.

This compulsory toner consumption processing does not form an excessively-overlaid image portion in which three or more toner images are overlaid, and has a higher compulsory toner consumption efficiency than a compulsory toner consumption processing in which two short compulsory consumption toner images are formed by using the two color toners.

(Embodiment I)

The image forming apparatus of Embodiment I is characterized in that, in the image forming apparatus of Embodiment G or H, the controller performs the compulsory toner consumption processing in such a manner that when the compulsory consumption toner image is formed using one of the plural image bearers and one color toner, a long compulsory consumption toner image of the one color toner is formed on the one image bearer, and the long compulsory consumption toner image is transferred to the transfer medium to form the compulsory consumption toner image.

This compulsory toner consumption processing has a higher compulsory toner consumption efficiency than a compulsory toner consumption processing in which one short compulsory consumption toner image is formed by using the color toner.

(Embodiment J)

The image forming apparatus of Embodiment J is characterized in that, in the image forming apparatus of any one of Embodiments G to I, the controller performs control such that when the controller performs a continuous printing operation of forming two or more toner images on two or more recording sheets, the controller performs the compulsory toner consumption processing in parallel with the continuous printing operation, wherein the compulsory consumption toner image is transferred to an inter-sheet area of the transfer belt between two sheet contacting areas of the transfer belt (i.e., between an area of the transfer belt with which one of the recording sheets is to be contacted to receive a toner image and another area of the transfer medium with which next one of the recording sheets is to be contacted to receive a toner image).

In this image forming apparatus, the compulsory consumption toner image is formed in the inter-sheet area of the transfer medium, and therefore the compulsory toner consumption processing can be performed even after every one print.

EFFECT OF THIS DISCLOSURE

The image forming apparatus of this disclosure can reduce deterioration of compulsory toner consumption efficiency, which is caused by forming compulsory consumption toner images side by side with a space therebetween, without forming an excessively-overlaid image portion in which three or more toner images are overlaid.

Additional modifications and variations of the present invention are possible in light of the above teachings. It is therefore to be understood that within the scope of the appended claims the invention may be practiced other than as specifically described herein.

What is claimed is:

1. An image forming apparatus comprising:

an image forming device which includes at least four image bearers and which forms images of color toners on corresponding image bearers of the at least four image bearers;

a transferring device which includes a movable transfer medium and which transfers the color toner images on the at least four image bearers to the transfer medium; and a controller to control the image forming apparatus, wherein the controller performs a compulsory toner consumption processing including calculating a necessary toner compulsory consumption amount of each of the color toners to determine a necessary toner compulsory consumption cumulative amount thereof; specifying color toners whose necessary toner compulsory consumption cumulative amount is greater than a threshold value; forming compulsory consumption toner images of the specified color toners on the corresponding image bearers; and transferring the compulsory consumption toner images to the transfer medium to form a compulsory consumption combined toner image on the transfer medium, wherein when a number of the specified color toners is three or more, the compulsory consumption combined toner image includes at least two overlaid image portions each consisting of two of the compulsory consumption toner images, wherein the at least two overlaid image portions are arranged side by side with a space therebetween in a first direction perpendicular to a moving direction of the transfer medium.

2. The image forming apparatus according to claim 1, wherein when the number of the specified color toners is three, the compulsory consumption combined toner image is an anomalous compulsory consumption toner image which includes first and second short compulsory consumption toner images of two of the specified color toners and a long compulsory consumption toner image of the other of the specified color toners, wherein the first and second short compulsory consumption toner images are arranged side by side with a space therebetween and the long compulsory consumption toner image is overlapped with each of the first and second short compulsory consumption toner images to form the at least two overlaid image portions.

3. The image forming apparatus according to claim 2, wherein the toner of the long compulsory consumption toner image has a highest necessary toner compulsory consumption cumulative amount among the specified three color toners.

4. The image forming apparatus according to claim 1, wherein when the number of the specified color toners is four, the compulsory consumption combined toner image is a first-direction parallel compulsory consumption toner image which includes, as the at least two overlaid image portions, first and second short compulsory consumption toner images which consist of two of the specified color toners and are overlaid, and third and fourth short compulsory consumption toner images which consist of the other two of the specified color toners and are overlaid.

5. The image forming apparatus according to claim 1, wherein the controller performs the compulsory toner consumption processing in such a manner that positions of the at least two overlaid image portions are changed with each other at intervals.

6. The image forming apparatus according to claim 1, wherein the controller performs the compulsory toner consumption processing in such a manner that positions of the at least two overlaid image portions are changed with each other in a next compulsory toner consumption processing.

7. The image forming apparatus according to claim 1, wherein the transfer medium is an endless multi-layer transfer belt having an outermost layer made of an elastic material, and the image forming apparatus further comprises:

a nip forming member to form a transfer nip with the transfer belt by contacting the transfer belt;

a transfer power source to output a transfer bias of an AC and DC superimposition voltage to the nip forming member so that a transfer current flows at the transfer nip;

a sheet feeding device to feed a recording sheet to the transfer nip;

a first cleaner to clean a surface of the transfer belt after the transfer belt passes the transfer nip; and a second cleaner to clean a surface of the nip forming member after the nip forming member passes the transfer nip, wherein the color toner images on the transfer belt to be output as a print are transferred to the recording sheet at the transfer nip and toner remaining on the transfer belt without being transferred to the recording sheet is removed therefrom by the first cleaner, and wherein the compulsory consumption combined toner image on the transfer belt is transferred to the nip forming member at the transfer nip and then removed from the nip forming member by the second cleaner.

8. The image forming apparatus according to claim 7, wherein the controller performs control such that when a continuous printing operation of forming two or more toner images on two or more of the recording sheet is performed, the controller performs the compulsory toner consumption processing in parallel with the continuous printing operation, wherein the compulsory consumption combined toner image is transferred to an inter-sheet area of the transfer belt between two areas of the transfer belt contacting the two or more of the recording sheet.

* * * * *